US007629955B2

(12) United States Patent
Asao et al.

(10) Patent No.: US 7,629,955 B2
(45) Date of Patent: Dec. 8, 2009

(54) COLOR DISPLAY DEVICE

(75) Inventors: Yasufumi Asao, Atsugi (JP); Hideo Mori, Yokohama (JP); Yutaka Inaba, Hino (JP)

(73) Assignee: Canon Kabushiki Kaisha, Tokyo (JP)

( * ) Notice: Subject to any disclaimer, the term of this patent is extended or adjusted under 35 U.S.C. 154(b) by 471 days.

(21) Appl. No.: 11/275,129

(22) Filed: Dec. 13, 2005

(65) Prior Publication Data

US 2007/0205972 A1 Sep. 6, 2007

(30) Foreign Application Priority Data

Dec. 15, 2004 (JP) ..... 2004-363719
Dec. 2, 2005 (JP) ..... 2005-349845

(51) Int. Cl.
*G09G 3/36* (2006.01)

(52) U.S. Cl. ..... 345/96; 345/79; 345/89

(58) Field of Classification Search ..... 345/89, 345/96, 209, 695, 87, 79
See application file for complete search history.

(56) References Cited

U.S. PATENT DOCUMENTS 5,615,027 A 3/1997 Kuribayashi et al.
6,195,137 B1 2/2001 Inaba et al.
6,326,981 B1 12/2001 Mori et al.
6,469,684 B1 * 10/2002 Cole ..... 345/58
6,556,181 B2 * 4/2003 Yamada et al. ..... 345/88
2001/0017607 A1 * 8/2001 Kwon et al. ..... 345/87
2002/0015110 A1 * 2/2002 Brown Elliott ..... 348/589
2003/0025662 A1 * 2/2003 Park ..... 345/88
2004/0051724 A1 * 3/2004 Elliott et al. ..... 345/694
2006/0055713 A1 3/2006 Asao et al.

FOREIGN PATENT DOCUMENTS

JP 8-234165 9/1996
WO 2004-042687 5/2004
WO WO 2004042687 A2 * 5/2004

OTHER PUBLICATIONS

Asao et al., 34:3 Quasi-and Analog-Full-Color Displaying Methods with High Light Efficiency in Super-High-Resolution LCDs; SID '04 Digest, ISSN/0004-0966X/3502-1110, pp. 1110-1113.

* cited by examiner

*Primary Examiner*—Amare Mengistu
*Assistant Examiner*—Koosha Sharifi
(74) *Attorney, Agent, or Firm*—Fitzpatrick, Cella, Harper & Scinto

(57) ABSTRACT

An active matrix display apparatus includes an active matrix display panel comprising a plurality of pixels arranged in a matrix in a row direction and a column direction, each pixel being constituted by a plurality of subpixels; and a drive circuit for applying a voltage to each of the subpixels so that a polarity of the voltage is inverted at a predetermined period in each of a row direction and a column direction. The plurality of subpixels are arranged in the row direction at a period different from half of the predetermined period of polarity inversion of the voltage in the row direction, thus providing flicker-less color display device even when general driver ICs for dot inversion drive are used.

12 Claims, 24 Drawing Sheets

(a)

(b)

(a)

(b)

(a)

| | | | | | | | |
|---|---|---|---|---|---|---|---|
| G + | M1 + | M2 + | M3 - | G - | M1 - | M2 + | M3 + |
| G - | M1 - | M2 - | M3 + | G + | M1 + | M2 - | M3 - |
| G + | M1 + | M2 + | M3 - | G - | M1 - | M2 + | M3 + |
| G - | M1 - | M2 - | M3 + | G + | M1 + | M2 - | M3 - |

(b)

| | | | | | | | |
|---|---|---|---|---|---|---|---|
| G - | M1 - | M2 - | M3 + | G + | M1 + | M2 - | M3 - |
| G + | M1 + | M2 + | M3 - | G - | M1 - | M2 + | M3 + |
| G - | M1 - | M2 - | M3 + | G + | M1 + | M2 - | M3 - |
| G + | M1 + | M2 + | M3 - | G - | M1 - | M2 + | M3 + |

FIG.21

(A)

| | | | | | | | | | | | | | | | |
|---|---|---|---|---|---|---|---|---|---|---|---|---|---|---|---|
| G | M1 | M2 | M3 | G | M1 | M2 | M3 | G | M1 | M2 | M3 | G | M1 | M2 | M3 |
| M2 | M3 | G | M1 | M2 | M3 | G | M1 | M2 | M3 | G | M1 | M2 | M3 | G | M1 |
| G | M1 | M2 | M3 | G | M1 | M2 | M3 | G | M1 | M2 | M3 | G | M1 | M2 | M3 |
| M2 | M3 | G | M1 | M2 | M3 | G | M1 | M2 | M3 | G | M1 | M2 | M3 | G | M1 |

(B)

| | | | | | | | | | | | | | | | |
|---|---|---|---|---|---|---|---|---|---|---|---|---|---|---|---|
| G | M1 | M2 | M3 | G | M1 | M2 | M3 | G | M1 | M2 | M3 | G | M1 | M2 | M3 |
| M2 | M3 | G | M1 | M2 | M3 | G | M1 | M2 | M3 | G | M1 | M2 | M3 | G | M1 |
| G | M1 | M2 | M3 | G | M1 | M2 | M3 | G | M1 | M2 | M3 | G | M1 | M2 | M3 |
| M2 | M3 | G | M1 | M2 | M3 | G | M1 | M2 | M3 | G | M1 | M2 | M3 | G | M1 |

FIG.22

| | | | | | |
|---|---|---|---|---|---|
| G | M | G | M | G | M |
| M | G | M | G | M | G |
| G | M | G | M | G | M |
| M | G | M | G | M | G |

FIG.23 PRIOR ART (a)

| | | | | | | |
|---|---|---|---|---|---|---|
| 1ST ROW | G + | M + | G + | M - | G - | M - |
| 2ND ROW | M - | G - | M - | G + | M + | G + |
| 3RD ROW | G + | M + | G + | M - | G - | M - |
| 4TH ROW | M - | G - | M - | G + | M + | G + |

(b)

| | | | | | | |
|---|---|---|---|---|---|---|
| 1ST ROW | G - | M - | G - | M + | G + | M + |
| 2ND ROW | M + | G + | M + | G - | M - | G - |
| 3RD ROW | G - | M - | G - | M + | G + | M + |
| 4TH ROW | M + | G + | M + | G - | M - | G - |

FIG.24 PRIOR ART

COLOR DISPLAY DEVICE

FIELD OF THE INVENTION AND RELATED ART

The present invention relates to an active matrix display apparatus, particularly an active matrix display apparatus for effecting display by voltage polarity inversion drive.

A display device for effecting color display depending on three types of image signals for red (G), green (G), and blue (B) has been conventionally used. A color liquid crystal display device as an example of such a color display device has advantages that it is thin and provides low power consumption and high display qualities, so that it is applied to various color display apparatuses, such as a mobile phone, a monitor for personal computer (PC), and a home television set.

Here, as an example of such a color liquid crystal display device, there has been known a color liquid crystal display device in which one pixel is divided into not less than three subpixels which are provided with color filters of R, G and B, respectively, and which are individually driven to effect full-color display by a color mixture effect on the basis of a concept of a superposition additive process of RGB. Such a color liquid crystal display device has an advantage that it can readily realize a high color-reproduction performance.

Incidentally, when the color liquid crystal display device is driven, as a means for solving problems on display such as flickering and cross-talk, dot inversion drive methods in which voltages of different polarities are applied to adjacent pixels, respectively, have been generally used. Of dot inversion drive methods, the 3-dot inversion drive method proposed in Japanese Laid-Open Patent Application No. Hei 8-234165 such that a unit pixel is constituted by RGB subpixels and a voltage of the same polarity is applied in the unit pixel, i.e., the polarity of the applied voltage is switched every 3 adjacent subpixels, has been widely used.

In order to perform such a 3-dot inversion drive method, general-purpose driver ICs have been used. This is very important for providing a product at low cost.

On the other hand, as another example of the color liquid crystal display device, there is an ECB-type (electrically controlled birefringence (effect)-type) color liquid crystal display device in which, e.g., a liquid crystal cell comprising a liquid crystal disposed between a pair of substrates is interposed between polarizers on front and rear sides thereof to prepare a transmission-type color liquid crystal display device.

Here, in the case of the transmission-type color liquid crystal display device, linearly polarized light which enters and passes through one of the polarizers is changed to elliptical polarized light comprising respective waveform light components different in polarized state by the action of birefringence during a process of passing through the liquid crystal cell. The elliptically polarized light enters and passes through the other polarizer and is changed to colored light having a color depending on a ratio of light intensities of the respective wavelength light components constituting the light. On the basis of a similar principle, it is also possible to realize a reflective-type color liquid crystal display device.

As described above, in the ECB-type color liquid crystal display device, light is colored by utilizing the birefringence action of the liquid crystal and the polarization action of the polarizer, and thus there is no light absorbance by a color filter, so that it is possible to effect bright color display by increasing a light transmittance. Further, a birefringence characteristic of the liquid crystal layer varies depending on an applied voltage, so that it is possible to change a color of transmitted light or reflected light by controlling the applied voltage to the liquid crystal cell. Accordingly, it is also possible to display a plurality of colors at the same pixel.

One of the present inventors has proposed a color display apparatus using a so-called hybrid color liquid crystal display mode as described in International Patent Publication No. WO2004/042687 and "SID '04 Digest", pp. 1110-1113. In this liquid crystal display mode, by utilizing a coloring phenomenon based on the birefringence effect (ECB effect), color display is effected by using a unit pixel constituted by two color filters provided with a G (green) color filter and a M (magenta) color filter, respectively.

When compared with a RGB color filter method in which three subpixels are provided with three color filters of RGB, respectively, the number of subpixels constituting the unit pixel can be reduced from 3 to 2. As a result, it is possible to realize an inexpensive color liquid crystal display device. Further, a degree of light absorption is decreased, so that it is possible to realize a light utilization efficiency higher than that in the case of the conventional RGB color filter method.

Further, in the hybrid color liquid crystal display mode, a gradation display ability can be increased by further dividing the subpixel provided with the magenta color filter into a plurality of portions. It is also possible to use a method in which analog full-color display is effected by additionally disposing a minute red subpixel and/or a minute blue subpixel.

In this case, the unit pixel is constituted by subpixels divided depending on gradation levels, so that the number of subpixels is increased.

In the hybrid color liquid crystal display mode, the liquid crystal used in a vertically aligned (VA) or bend aligned liquid crystal which is frequently used in an ordinary display. Accordingly, when a matrix display panel is driven by providing it with a driver circuit, it is possible to use the same driver ICs used in the ordinary display with respect to both scanning lines and signal lines. The use of general-purpose driver ICs is preferable also from the viewpoint of cost reduction of the display apparatus.

Most of the signal line-side driver ICs are prepared for the liquid crystal display using the unit pixel constituted by three subpixels of RGB, so that when they are used in the hybrid-type color liquid crystal display device using the unit pixel constituted by two subpixels, three outputs of RGB at one pixel on the driver IC side are used for driving the liquid crystal panel at 1.5 pixels. As a result, when compared with the RGB-type liquid crystal display having the same number of pixels, the number of the signal line-side driver ICs is decreased to ⅔ of that of the RGB-type liquid crystal display.

A driving method of the active matrix-type hybrid color liquid crystal display panel is described in WO2004/04287 and the "SID" document mentioned above. In the VA mode, a state in which a voltage is not applied to both the two subpixels is a dark state, i.e., a black display state. When the same voltage is applied to both the two subpixels and a value thereof is increased, the display state is changed to a white display state. At the magenta subpixel, the color is changed from red to blue.

A nematic liquid crystal naturally shows a symmetrical electrooptical response characteristic with respect to an ordinate axis when positive and negative voltages are applied thereto, so that an optical response characteristic depending on an absolute value of the applied voltage should be obtained irrespective of a polarity of voltage in an AC drive in which a polarity of a drive voltage is inverted at a predetermined period.

However, in many cases of an actual color liquid crystal display device, it is difficult to apply positive and negative voltages to the liquid crystal layer so as to be completely symmetrical with respect to the ordinate by the influences of a voltage fluctuation of pixel electrode occurring when a scanning selection pulse is turned off, i.e., field-through and of residual DC remaining in an alignment film or the like.

In field inversion drive, a voltage of the same polarity is applied to the entire surface of panel in one field. When a frame frequency is 30 Hz, the panel is driven by a positive-polarity voltage for 1/60 sec in an odd field and a negative-polarity voltage for 1/60 sec in an even field.

As a result, displays with different optical characteristics are alternately performed every 1/60 sec, so that flickering of picture is caused to occur. In the hybrid-type color liquid crystal display device, the same problem also arises since the liquid crystal per se is used in the same alignment mode as in the case of an ordinary RGB color liquid crystal display device.

A method used in the ordinary RGB color liquid crystal display device in order to suppress the flickering, i.e., line inversion drive in which a polarity of an applied voltage is inverted every one scanning line or dot inversion drive in which the polarity of the applied voltage is inverted not only every one scanning line but also every one pixel, is also effective in the hybrid color liquid crystal display device. In the line inversion drive or the dot inversion drive, at each pixel, displays with different optical characteristics are repeated at a frequency of 30 Hz but the optical characteristics of adjacent lines or adjacent pixels are spatially averaged. As a result, the resultant display is not substantially recognized as flicker by human eyes.

FIG. 23 is a schematic view showing an example of color filter arrangement in the conventional hybrid-type color liquid crystal display device. Referring to FIG. 23, a color filter of green represented by a symbol G and a color filter of magenta represented by a symbol M are arranged alternately.

When color filters are vertically arranged in a stripe pattern so that color filters of the same color are arranged in the same vertical line, an edge of a display image is colored in some cases. In order to alleviate this phenomenon, it is preferred to employ the color filter arrangement shown in FIG. 24 in which the color filters of different colors are alternately.

However, when general-purpose drivers used in the RGB color filter method is applied to the hybrid color liquid crystal display device having the pixel arrangement shown in FIG. 23, the following problem arises when the dot inversion drive is performed.

FIGS. 24(*a*) and 24(*b*) show a polarity at each pixel when the color liquid crystal display device is driven by the drivers for the RGB color filter method. In a polarity inversion drive method other than the dot inversion drive, one frame is constituted by two fields. FIG. 24(*a*) shows polarities of applied voltage in one (odd field) of the two fields, and FIG. 24(*b*) shows those in the other field (even field).

The dot inversion drive is performed by pixel unit, so that, as shown in FIGS. 24(*a*) and 24(*b*), adjacent three dots are inverted as a whole. In this case, when the polarity of applied voltage is noted, the following facts have been found.

In FIGS. 24(*a*) and 24(*b*), 12 unit pixels, i.e., 12 subpixels of G (green) and 12 subpixels of M (magenta) constituting an ECB-type color liquid crystal display device are depicted.

In the odd field (FIG. 24(*a*)), the number of G subpixels showing a positive (+) polarity is 8 to 12 and the number of G subpixels showing a negative (−) polarity is 4 of 12. On the other hand, the number of M subpixels showing (+) polarity is 4 and the number of M subpixels showing (−) polarity is 8.

In the even field (FIG. 24(*b*)), the number of (+) G subpixels is 4 and the number of (−) G subpixels is 8. On the other hand, the number of (+) M subpixels is 8 and the number of (−) M subpixels is 4.

When monocolor display of green is effected, eight G subpixels are driven by the (+) polarity voltage and four G subpixels are driven by the (−) polarity voltage in the odd field. On the other hand, in the even field, four G subpixels are driven by the (+) polarity voltage and eight G subpixels are driven by the (−) polarity voltage. As described above, the optical characteristic is not completely symmetrical during the positive polarity drive and the negative polarity drive. However, even when the optical characteristic during the positive polarity drive and that during the negative polarity drive are asymmetrical, an optical property in the odd field is identical to an optical property in the even field, so that no flicker occurs. However, in the case shown in FIGS. 24(*a*) and 24(*b*), the number of G subpixels driven by the (+) polarity drive is not equal to that of G subpixels driven by the (−) polarity drive in each field, so that resultant optical properties in the two fields are different from each other. As a result, flicker is caused to occur at 30 Hz.

Similarly, when monocolor display of blue is performed at the M subpixels, the numbers of M subpixels driven by the (+) polarity drive and those driven by the (−) polarity drive are not equal to each other, so that flicker is caused to occur.

Even when display other than the monocolor displays is performed, there is no change in that the respective three primary colors of red, green and blue are not equivalent. As a result, flicker is caused to occur.

The above results are obtained with respect to 12 pixels (4 rows×3 columns) but are true for a wider area since subpixels constituting the area merely have a pattern of repetition of the unit shown in FIGS. 23 and 24.

SUMMARY OF THE INVENTION

The present invention has been accomplished in view of these circumstances.

An object of the present invention is to provide a color liquid crystal display device causing no flicker even in the case where general-purpose driver ICs are used.

According to an aspect of the present invention, there is provided an active matrix display apparatus, comprising:

an active matrix display panel comprising a plurality of pixels arranged in a matrix in a row direction and a column direction, each pixel being constituted by a plurality of subpixels; and a drive circuit for applying a voltage to each of the subpixels so that a polarity of the voltage is inverted at a predetermined period in each of a row direction and a column direction;

wherein the plurality of subpixels are arranged in the row direction at a period different from half of the predetermined period of polarity inversion of the voltage in the row direction.

In a preferred embodiment, the half of the predetermined period of polarity inversion of the voltage in the row direction is 3 in terms of the number of subpixels. Further, in another preferred embodiment, the period of the subpixel arrangement in the row direction is 2 in terms of the number of subpixels, and one of 2 subpixels in the period is provided with a green color filter and the other subpixel is provided with a magenta color filter.

Further, in another preferred embodiment, the period of the subpixel arrangement in the row direction is not less than 4 in terms of the number of subpixels, and one of not less than 4 subpixels in the period is provided with a green color filter and not less than 2 other subpixels are provided with a magenta color filter.

Further, in another preferred embodiment, the period of the subpixel arrangement in the row direction is not less than 5 in terms of the number of subpixels; and one of not less than 5 subpixels in the period is provided with a green color filter and not less than 2 other subpixels are provided with a magenta color filter, another one subpixel is provided with a red color filter, and more another one subpixel is provided with a blue color filter.

In the active matrix display apparatus, the predetermined period of polarity inversion of the voltage in the column direction may preferably be 2 rows. Further, subpixel arrangement in a row may preferably have the same arrangement pattern as subpixel arrangement in an adjacent row. In the active matrix display apparatus, in a common period of subpixel arrangement and polarity inversion of voltage in the row direction, an odd number of recurring units of subpixel arrangement and an even number of recurring units of polarity inversion of voltage may preferably be present, and subpixel arrangement in a row may preferably be inverted and shifted from subpixel arrangement in an adjacent row by half of the period of subpixel arrangement.

In another preferred embodiment, in a common period of arrangement of subpixels in the row direction and polarity inversion of voltage in the row direction, an odd number of recurring units of subpixel arrangement and an off number of recurring units of polarity inversion of voltage are present, and subpixels arranged in a row are arranged at a period deviated from subpixels arranged in an adjacent row by half of the period and are arranged in a direction opposite to that of the subpixels arranged in the adjacent row.

According to another aspect of the present invention, there is provided a method of driving an active matrix display apparatus, comprising:

a step of driving an active matrix display panel comprising a plurality of pixels arranged in a matrix in a row direction and a column direction, each pixel being constituted by a plurality of subpixels; by a drive circuit for applying a voltage to each of the subpixels so that a polarity of the voltage is inverted at a predetermined period in each of a row direction and a column direction;

wherein the plurality of subpixels are arranged in the row direction at a period different from half of the predetermined period of polarity inversion of the voltage in the row direction.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 21(*a*) and 21(*b*) are schematic views each showing a constitution and an arrangement of subpixels in a field in Example 2.

FIGS. 22(*a*) and 22(*b*) are schematic views each showing a subpixel arrangement in a field in Example 3.

FIG. 23 is a schematic view showing a subpixel arrangement in a conventional hybrid-type color liquid crystal display apparatus.

FIGS. 24(*a*) and (*b*) are schematic views showing a subpixel arrangement and a voltage polarity in the conventional hybrid-type color liquid crystal display apparatus.

DETAILED DESCRIPTION OF THE PREFERRED EMBODIMENTS

Hereinbelow, embodiments of the active matrix display apparatus according to the present invention will be described more specifically with reference to the drawings.

Herein, flicker (flickering) is such a phenomenon that the number of positive-polarity driven subpixels in a field is different from that of negative-polarity driven subpixels in the field in a polarity inversion drive for effecting drive by inverting a polarity of a drive voltage in adjacent two fields, so that even when the same image is displayed in an odd field and a subsequent even field, the display image is observed in a flickering state.

In a conventional drive method in which dot inversion drive is performed for every three-dot unit, i.e., a polarity inversion pitch is equal to a pixel pitch, the flicker in the above meaning is not caused to occur.

However, there are various possibilities of the use of a hybrid color display method and such a constitution that one pixel is constituted by four dots (subpixels) of red (R), green (G), blue (B), and white (W), other than the pixel constitution consisting of three dots of RGB as one (pixel) unit. In the present invention, attention is directed toward that a polarity inversion drive at a 3-dot pitch identical to that in the case of the RGB color display method is advantageous for reduction in production costs even in matrix display at a pixel pitch other than 3-dot pitch, so that the present invention provides a method of alleviating flicker in such cases.

Hereinbelow, the case where the number of position-polarity driven subpixels is different from the number of negative-polarity driven subpixels in one field will be described.

Figure 1:
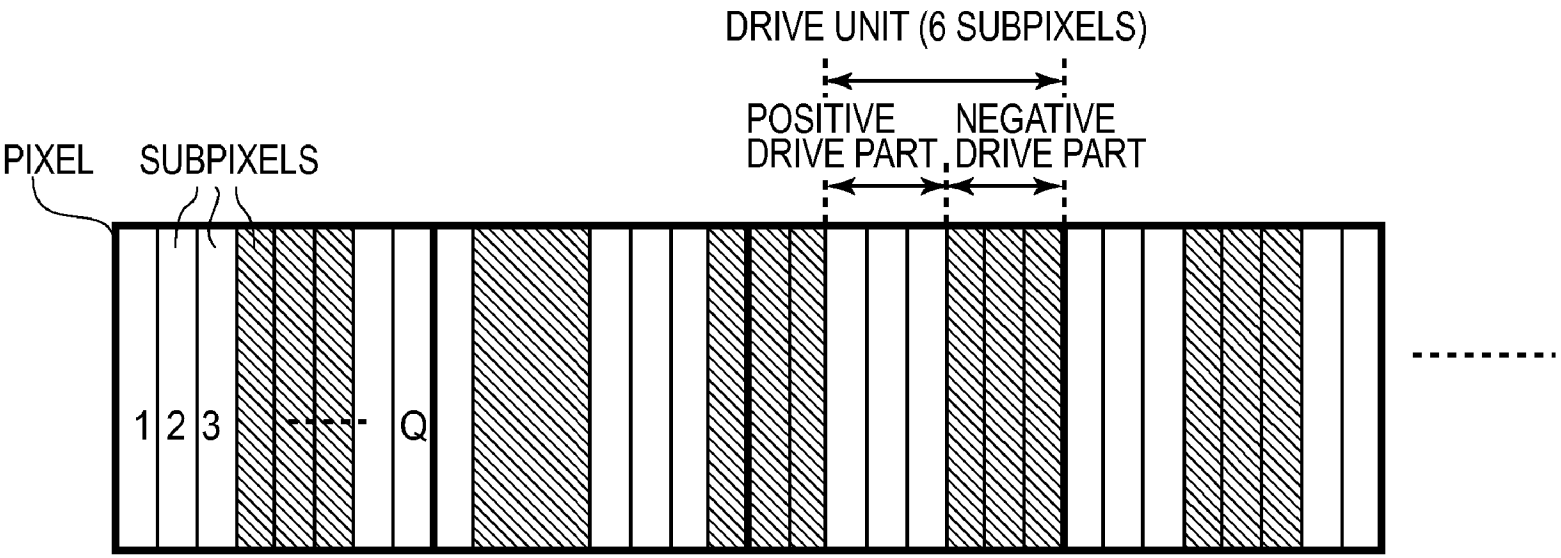
FIG. 1 is a schematic view showing an subpixel arrangement in one row in the active matrix display apparatus according to the present invention.

1. Relationship Between a Polarity of Voltage and the Number of Subpixels in One Row FIG. 1 shows an arrangement of subpixels in a row direction in the case where one unit pixel comprises Q subpixels arranged in the row direction. FIG. 23 shows an arrangement of subpixels in the case of Q=2.

As shown in FIG. 1, an arrangement of each of dots (subpixels) in one row has such a pattern that an arrangement of Q subpixels is periodically repeated as one unit pattern. In the following description, this pattern is the same with respect to all the rows unless otherwise noted specifically.

In FIG. 1, a polarity of voltage applied to respective subpixels when the resultant matrix display panel having this pixel arrangement is driven every three dots in a polarity inversion drive manner is also shown. More specifically, blank (white) subpixels represent subpixels to which a positive (+)-polarity voltage is applied, and hatched subpixels represent subpixels to which a negative (−)-polarity voltage is applied. A period of polarity inversion is 6 dots which is referred to as a "drive unit".

Dots (subpixels) in one row are supplied with voltages of polarities in the order of (+), (−), (+), (−), . . . , for each 3 dots, and those in a subsequent row are supplied with voltages of polarities in the order of (−), (+), (−), (+), . . . , for each 3 dots.

Figure 2:
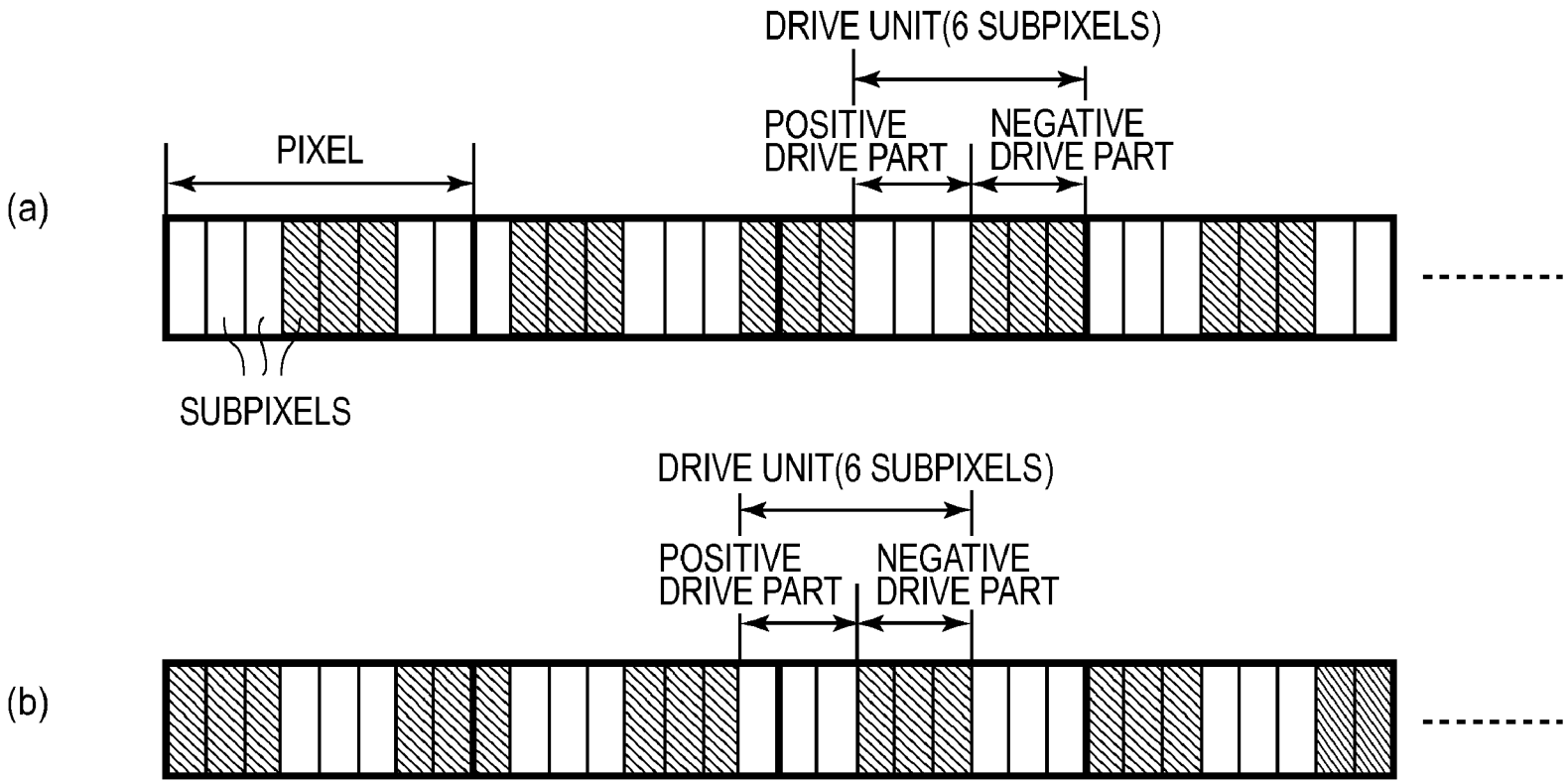
FIGS. 2(*a*) and 2(*b*) are schematic views showing a polarity of voltage during drive of the active matrix display apparatus of the present invention, wherein FIG. 2(*a*) shows the polarity of voltage in a field and FIG. 2(*b*) shows the polarity of voltage in a subsequent field.

The relationship between the subpixel arrangement and the polarity of applied voltage is inverted every field. FIGS. 2(*a*) and 2(*b*) show such polarity inversion states.

In one field (odd-numbered field), drive is performed at the polarities of voltages shown in FIG. 2(*a*) and in a subsequent field (even-numbered field), drive is performed at the polarities of voltages shown in FIG. 2(*b*).

Figure 3:
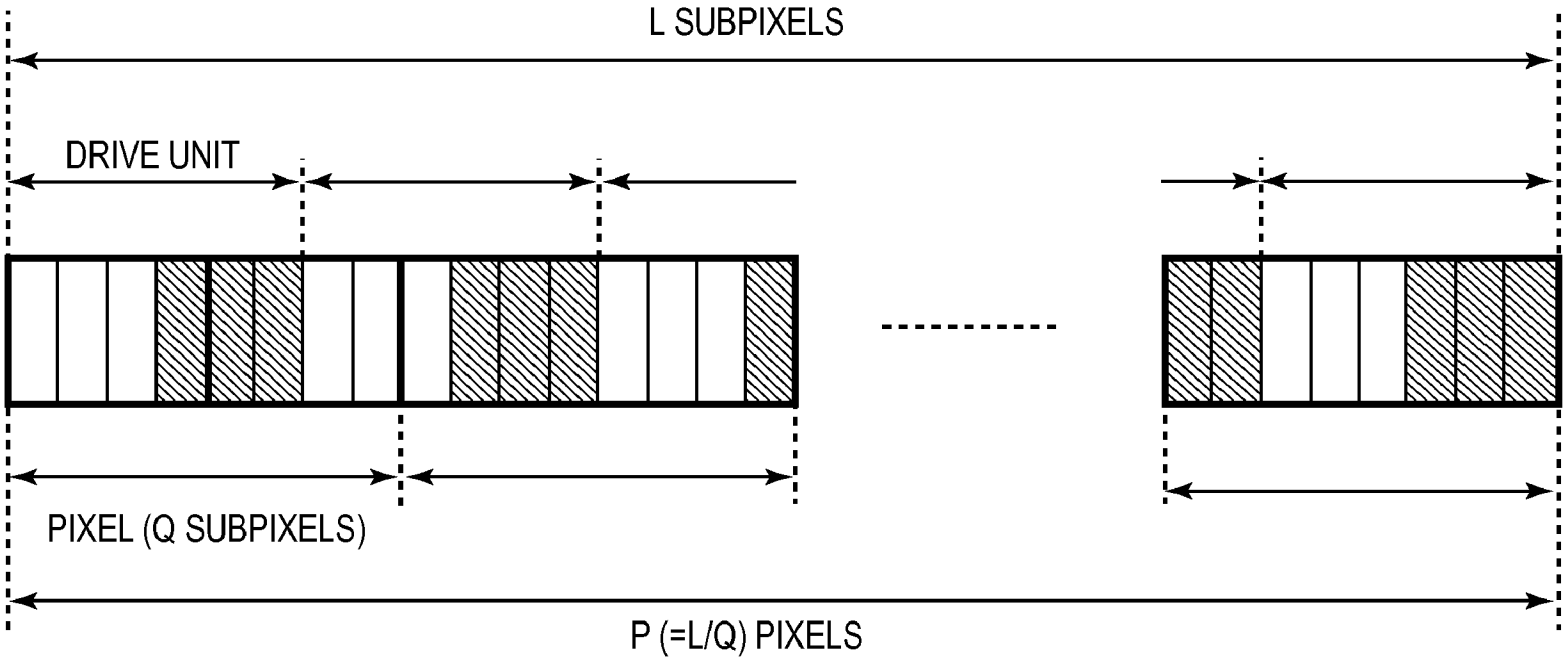
FIG. 3 is a schematic view showing a relationship between subpixel arrangement and a voltage polarity pattern in the active matrix display apparatus of the present invention.

FIG. 3 shows a relationship between a subpixel arrangement pattern and a voltage polarity pattern in one row. The voltage polarity is alternately changed between positive and negative for each 3 dots, so that it has a repetition pattern having a period of 6 dots. On the other hand, the subpixel pattern has a period of Q dots.

In view of both the voltage polarity and the subpixel arrangement, a minimum recurring unit of a dot pattern in the row direction is a least common multiple (referred to as "L") of 6 and Q. L is a minimum period of common periods including the period (6 dots) of the voltage polarity inversion and the subpixel arrangement period.

In these L dots, when the number of same polarity subpixels is counted to determine whether the number of positive subpixels is equal to the number of negative subpixels or not, other portions are repetition of the L dots as the minimum recurring units. As a result, it is possible to judge an imbalance of polarity with respect to all the subpixels.

In the case shown in FIG. 23, Q=2, so that a common least multiple of Q and 6 is 6. As a result, when the voltage polarity and the subpixel arrangement for L=6 dots are determined, other portions are a repetition of L.

The L dots as the recurring unit obtained by multiplying the period pattern of the voltage polarity by the period pattern of the subpixel arrangement contains L/Q (=P) unit pixels each consisting of Q subpixels as shown in FIG. 3.

When a particular subpixel A is noted, the L dots in one row contain P subpixels A. Of these P subpixels A, some subpixels are positive subpixels and other subpixels are negative subpixels, and the numbers of these subpixels are inverted every field. When the number of positive subpixels A in an odd(-numbered) field is taken as P1 and the number of negative subpixels A in the odd field is taken as P2 (P1+P2=P), in an even(-numbered) field, the number of positive subpixels A is P2 and that of negative subpixels A is P1.

Hereinbelow, separate explanation will be made with respect to two cases where P is an even number and an odd number.

(1-1) Case where P is an Even Number

Figure 4:
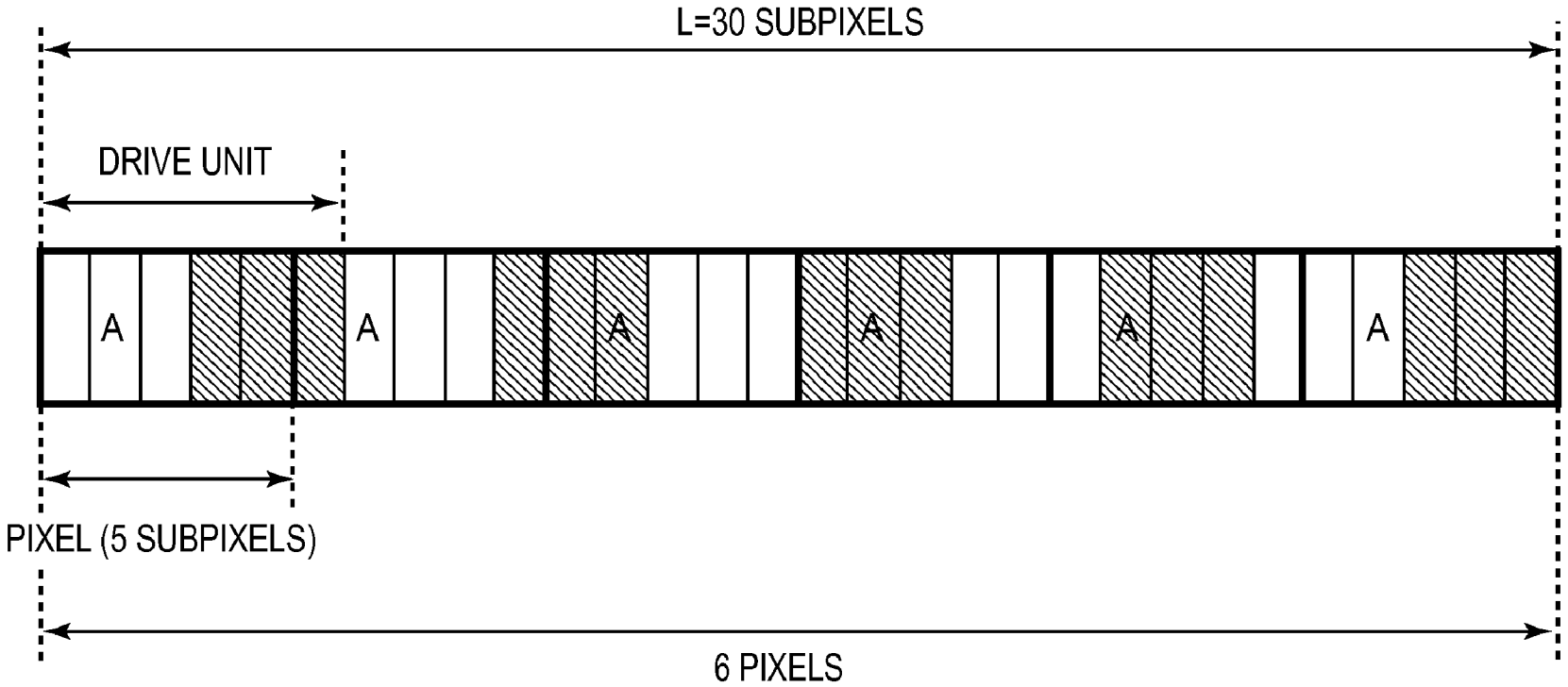
FIG. 4 is a schematic view showing a relationship between subpixel arrangement and a voltage polarity pattern in the active matrix display apparatus of the present invention in the case where the number of unit pixel P is an even number.

FIG. 4 shows an example of the case where P is an even number, wherein Q=5 and L=30 (i.e., P=L/Q=6).

The number of subpixels A (the second subpixel from the left in each unit pixel) is three for positive polarity (P1=3) and three for negative polarity (P2=3).

Figure 5:
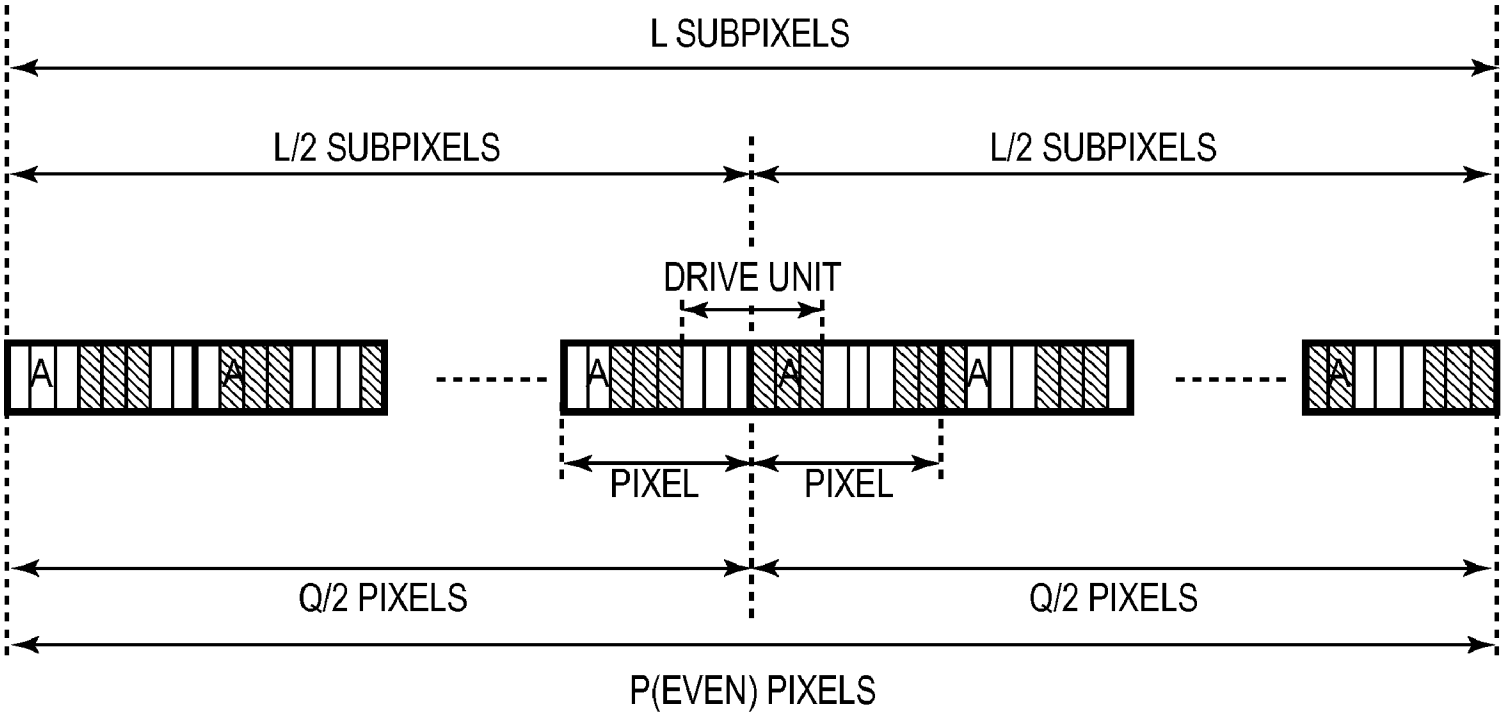
FIG. 5 is a schematic view showing a relationship between subpixel arrangement and a voltage polarity pattern in the active matrix display apparatus of the present invention in the case where the number of unit pixel P is an even number.

FIG. 5 shows a general example of the case where P is an even number.

Now, P is the even number, so that when the L dots in one row is bisected at the center, each of left and right L/2 dots is constituted by P/2 unit pixels.

However, in the voltage polarity pattern, L/2 is not a multiple of 6 (if L/2 is a multiple of 6, L/2 is a common multiple of 6 and Q, thus being contradictory to the assumption that L is the common least multiple), so that a drive unit of 6 dots are divided into two portions each consisting of 3 dots at the bisection point.

For this reason, the left L/2 dots have polarities in the order, from the left, of (+), (−), (+), (−), . . . , (+), and the right L/2 dots have polarities in the order, from the left, of (−), (+), (−), (+), . . . , (−). Three dots immediately left of the bisection point have a polarity opposite to that of three dots immediately right of the bisection point, so that the polarity of the subpixel A immediately left of the bisection point is also opposite to that of the subpixel A immediately right of the bisection point. Accordingly, it is found that the same number of the positive-polarity subpixels A and the negative-polarity subpixels A are contained in the L dots in one row (P1=P2).

(1-2) Case where P is an Odd Number

Figure 6:
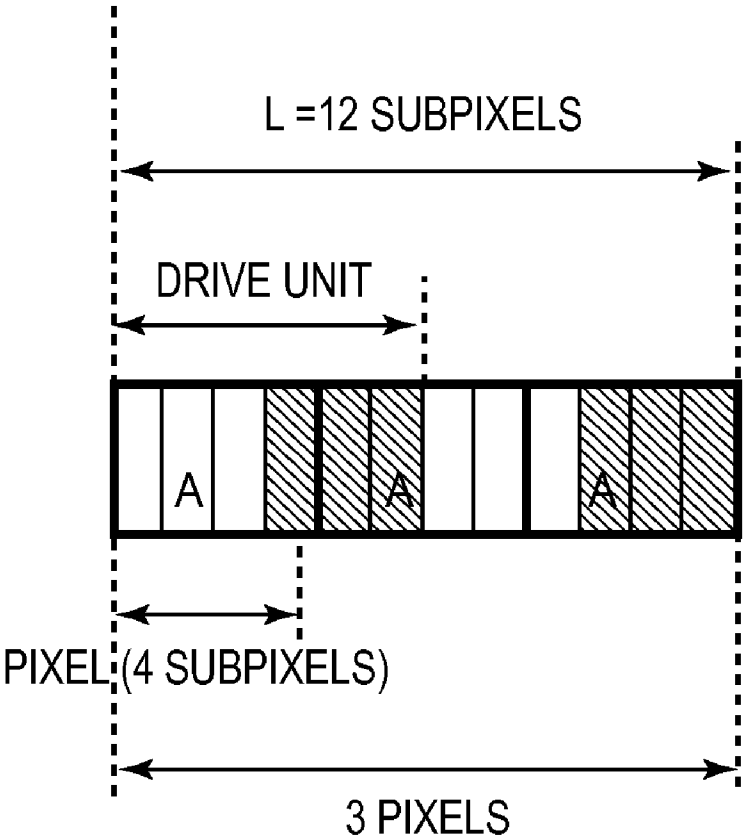
FIG. 6 is a schematic view showing a relationship between subpixel arrangement and a voltage polarity pattern in the active matrix display apparatus of the present invention in the case where the number of subpixels is 4.

FIG. 6 shows an example of the case where P is an odd number, wherein Q=4 and L=12 (i.e., P=L/Q=3).

Generally, when P is an odd number, P1 is not equal to P2. As a result, the number of positive-polarity subpixels A is not equal to that of negative-polarity subpixels A in the L dots in one row. In other words, when only one row is noted, there is a difference in optical characteristic between an even field and an odd field.

L=PQ is a multiple of 6, thus being an even number. For this reason, when P is an odd number, Q is required to be an even number.

Now, Q subpixels are divided into two equal (Q/2) subpixel groups consisting of a first group of $A_1, A_2, \ldots, A_{Q/2}$ and a second group of $A_{Q/2+1}, A_{Q/2+2}, \ldots, A_Q$.

Figure 7:
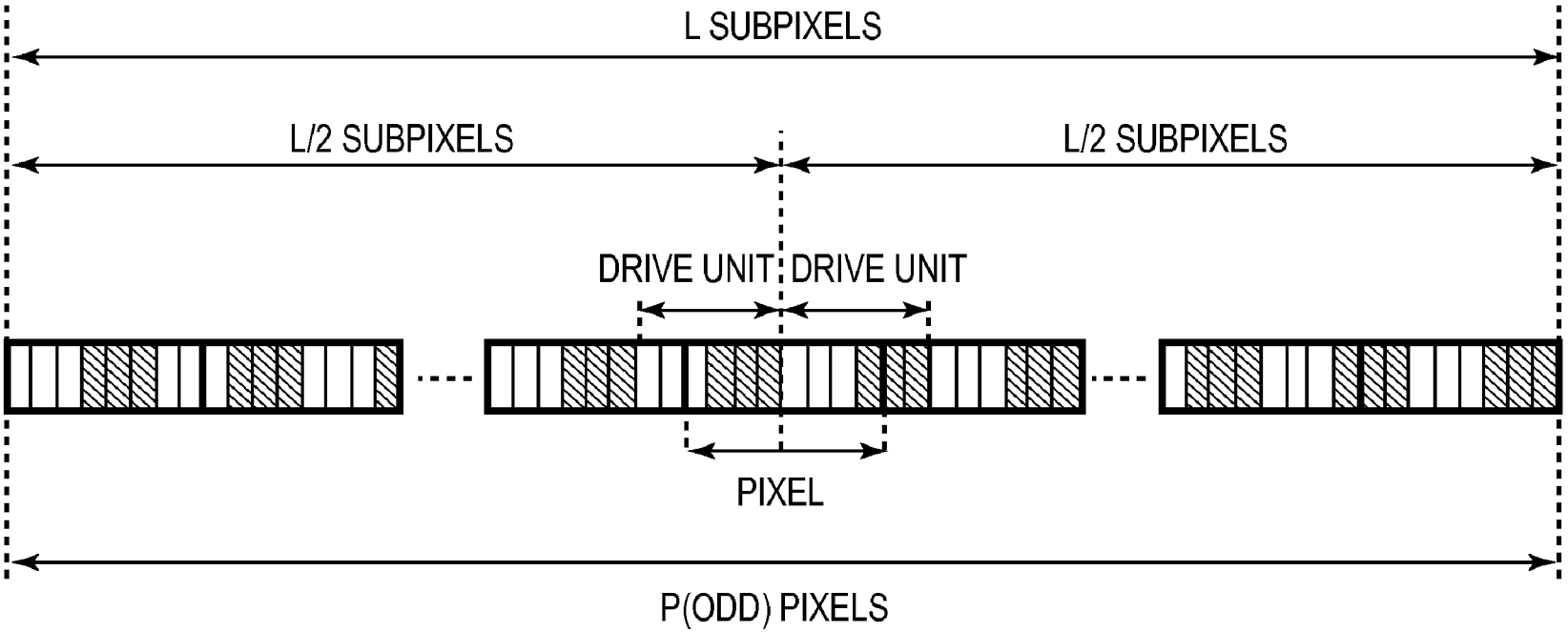
FIG. 7 is a schematic view showing a relationship between subpixel arrangement and a voltage polarity pattern in the active matrix display apparatus of the present invention in the case where the number of unit pixel P is an odd number of the number of J (L=6J) is an even number.

FIG. 7 shows a voltage polarity pattern in the case where P is an odd number but J (L=6J) is an even number.

When L dots in one row is bisected, the number of unit pixels (P) contained in the L dots is an odd number. As a result, as shown in FIG. 7, at the division (bisection) point, one unit pixel is divided into two positions at a boundary between the first and second groups.

The left L/2 dots of the division point in one row are subpixels which start from the first group and are terminated as the first group, and the right L/2 dots of the division point in one row are subpixels which start from the second group and are terminated as the second group.

On the other hand, as for the voltage polarity pattern, J is an even number, so that the drive units having a 6-dot period are just divided at the division point. As a result, the left L/2 dots of the division point in one row have the same voltage polarity pattern as that of the right L/2 dots of the division point in one row. In other words, each of the left L/2 dots and the right L/2 dots have a polarity pattern in the order, from the left, of (+), (−), (+), (−), (−).

Figure 8:
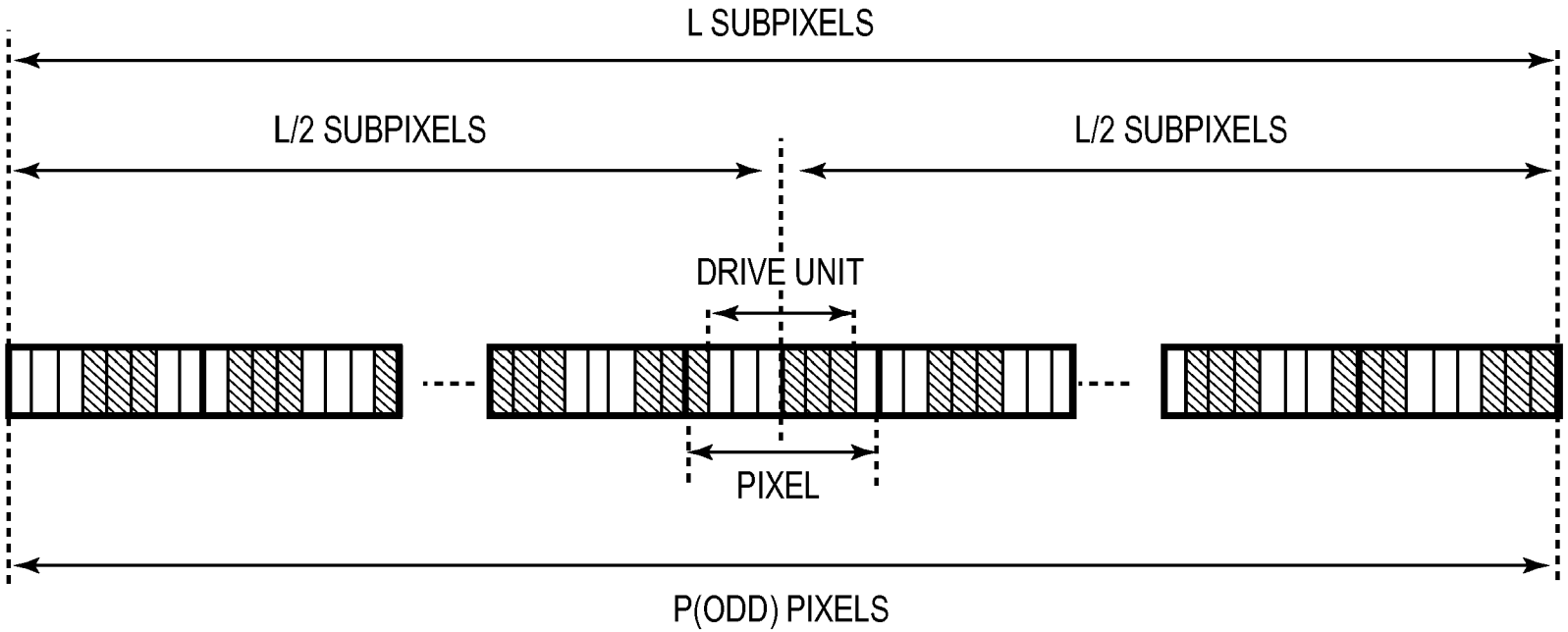
FIG. 8 is a schematic view showing a relationship between subpixel arrangement and a voltage polarity pattern in the active matrix display apparatus of the present invention in the case where the number of unit pixel P is an odd number and the number of J (L=6J) is an odd number.

FIG. 8 shows a voltage polarity pattern in the case where P is an odd number and J is also an odd number.

In the case where J is an odd number, when the L dots in one row is bisected, a drive unit of 6 dots is divided into two portions each consisting of 3 dots at the division (bisection) point. As a result, the left L/2 dots of the division point has an opposite voltage polarity pattern to the right L/2 dots of the division point. More specifically, the left L/2 dots have a voltage polarity pattern in the order, from the left, of (+), (−), (+), (−), . . . , (+) but the right L/2 dots have a voltage polarity pattern in the order, from the left, of (−), (+), (−), (+), . . . , (−).

As is understood from FIGS. 7 and 8, in even either case where J is the even number and is the odd number, imbalance of voltage polarity is caused to occur so long as P is the odd number.

2. Relationship Between Different Two Rows

The above-described results are those when the positive-polarity driven dots and the negative-polarity driven dots are compared in one row.

In the dot inversion drive or the line inversion drive, the drive voltage polarity in one row is opposite to that in an adjacent row.

Figure 9:
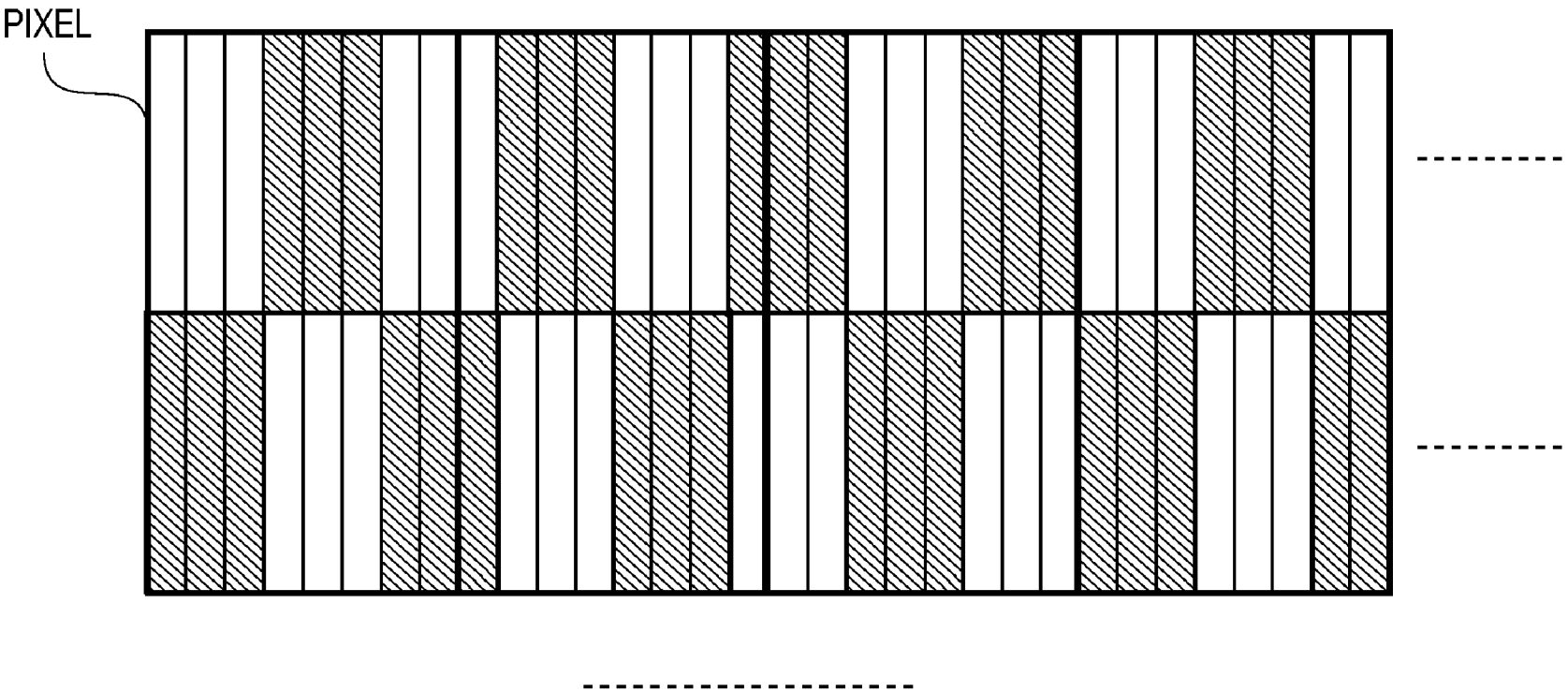
FIG. 9 is a schematic view generally showing subpixel arrangement in a row equal to that in an adjacent row.
Figure 10:
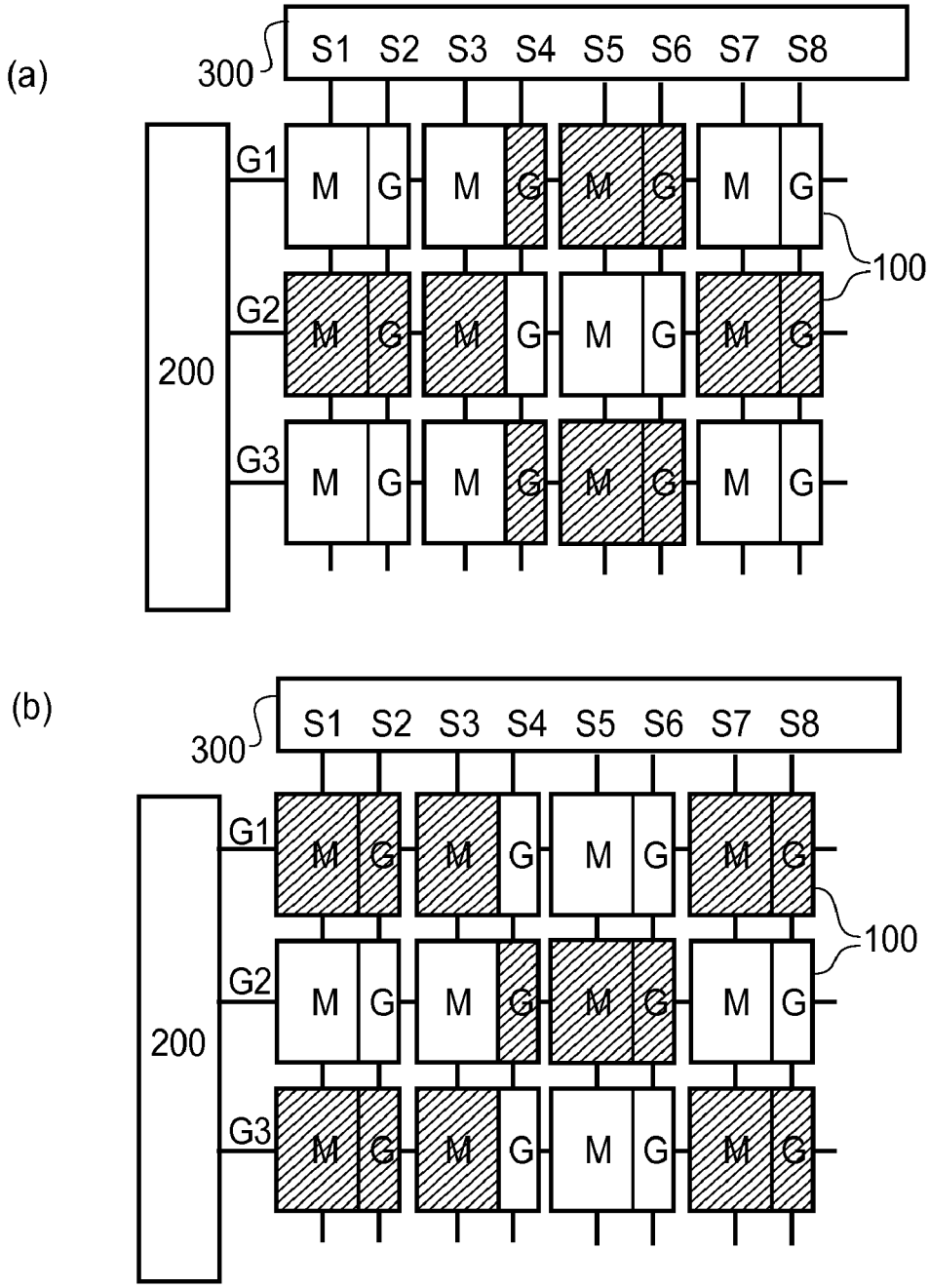
FIGS. 10(*a*) and 10(*b*) are schematic views each showing a matrix pixel arrangement, a subpixel constitution, and a drive voltage polarity in a field in an embodiment.

The case where the same subpixel arrangement is used in adjacent two rows is shown in FIG. 9, and specific examples thereof are shown in FIGS. 10(1), 10(*b*), 11(*a*), 11(*b*), 12(*a*) and 12(*b*). Herein, the "same subpixel arrangement" means that subpixels driven on the same signal line have the same arrangement pattern over a plurality of rows.

FIGS. 10(*a*) and 10(*b*) each shows a subpixel arrangement example with a stripe pattern of color filter in a field.

In the subpixel arrangement shown in FIGS. 10(*a*) and 10(*b*), two subpixels (M, G) arranged in a row direction constitute one pixel 100. Referring to FIGS. 10(*a*) and 10(*b*), M (magenta) subpixels are arranged on odd(-numbered) signal lines S1, S3, . . . in columns and G (green) subpixels are arranged on even(-numbered) signal lines S2, S4, . . . in columns. From an external row drive circuit 200 and an external column drive circuit 300, voltage signals are applied to the scanning lines G1, G2, . . . in a row direction and the signal lines S2, S2, . . . in a column direction, respectively. The scanning lines G1, G2, . . . are sequentially selected for every row and an image signal is supplied to the signal lines S1, S2, . . .

Figure 11:
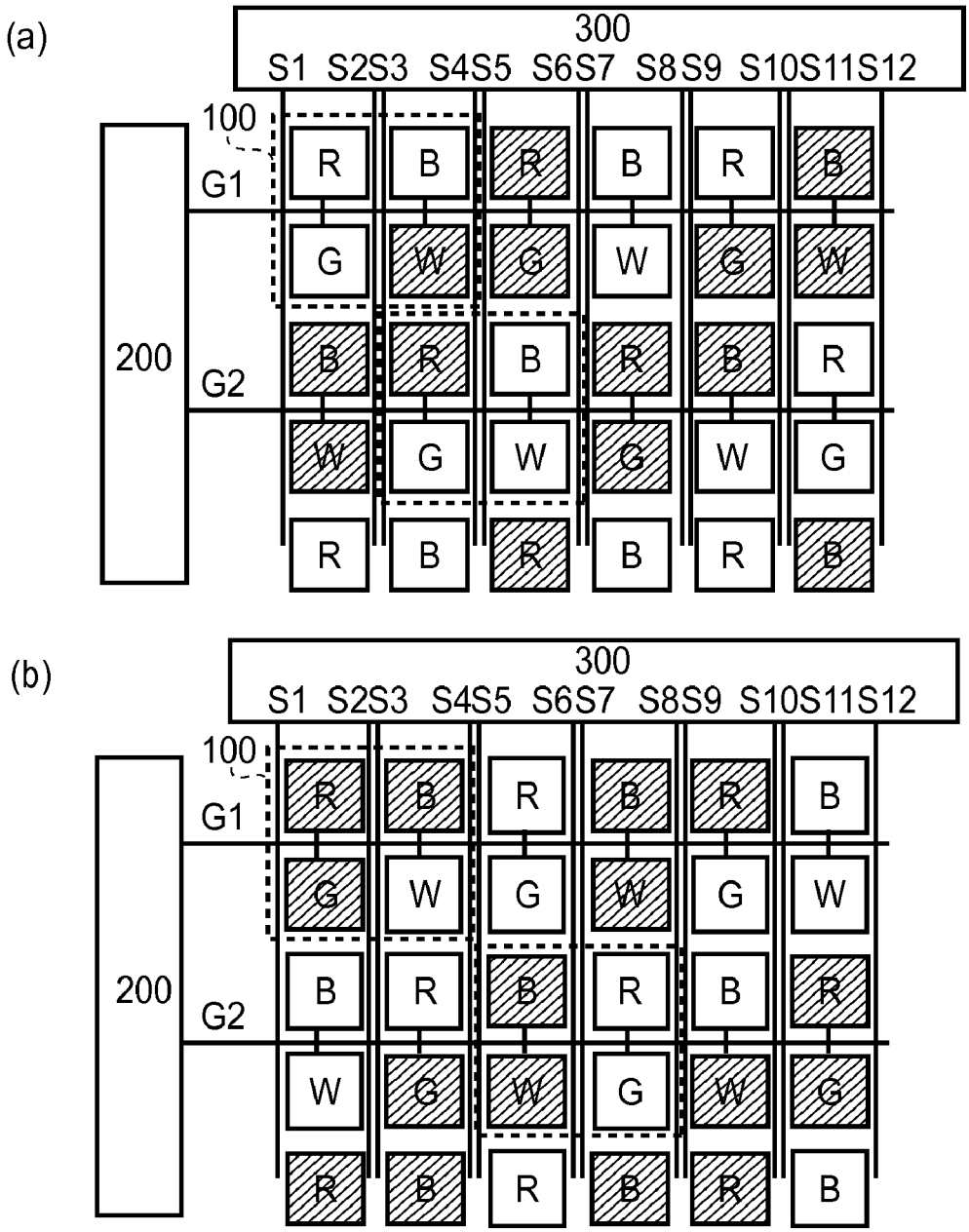
FIGS. 11(*a*) and 11(*b*) are schematic views each showing a matrix pixel arrangement, a subpixel constitution, and a drive voltage polarity in a field in another embodiment.

FIGS. 11(*a*) and 11(*b*) each shows a subpixel arrangement example in a field in which one pixel is constituted by 4 dots of red (R), green (G), blue (B), and white (W). This subpixels arrangement is also the same subpixel arrangement for each row since 4 dots of R, G, B and W are driven by the same signal lines, respectively.

Figure 12:
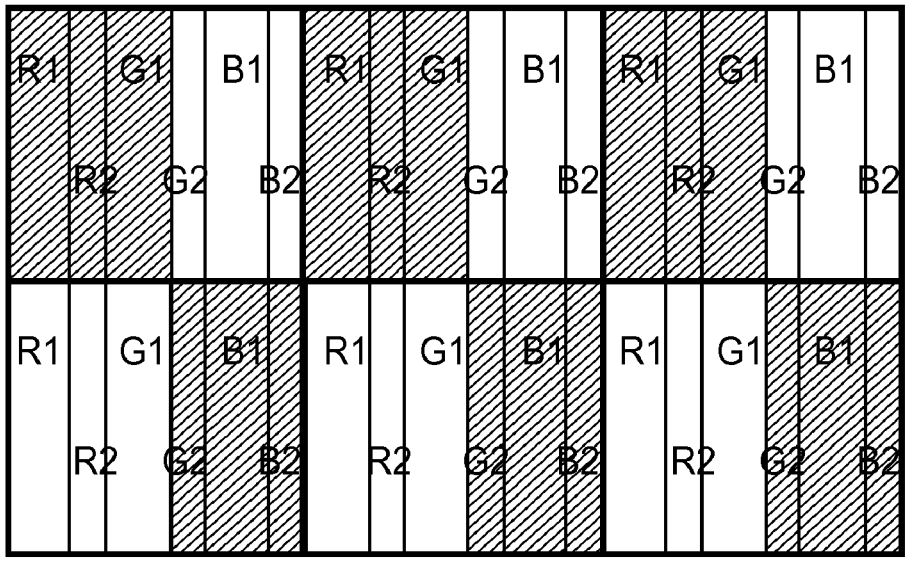
FIGS. 12(*a*) and 12(*b*) are schematic views each showing a matrix pixel arrangement, a subpixel constitution, and a drive voltage polarity in a field in a further embodiment.
Figure 12:
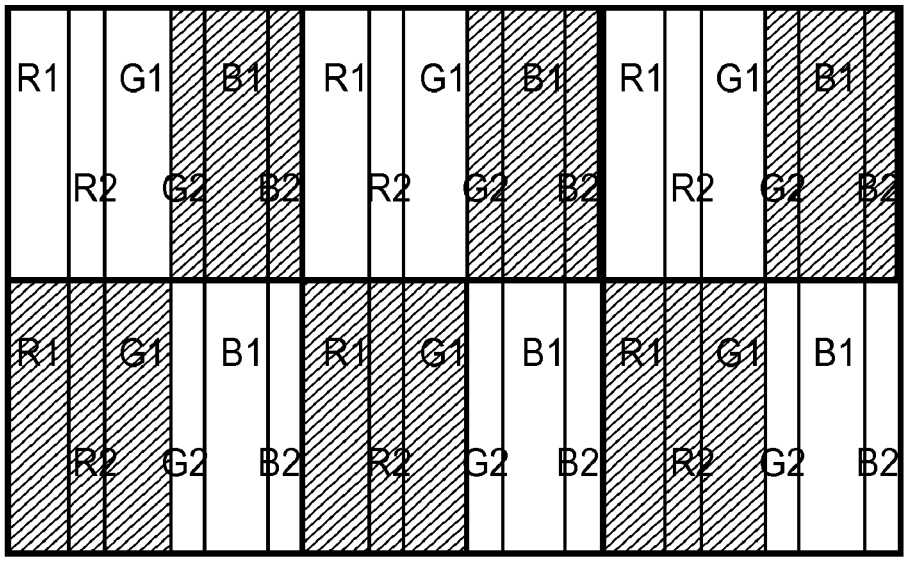

FIGS. 12(*a*) and 12(*b*) each shows a subpixel arrangement example in a field in which each of R, G and B is constituted by two subpixels and thus 6 subpixels constitute one pixel. For each color subpixel, the two subpixels are arranged in an areal ratio of 2:1 so as to provide 4 brightness levels, so that display of 64 colors in total is effected.

In each of FIGS. 10(*a*), 10(*b*), 11(*a*), 11(*b*), 12(*a*) and 12(*b*), the voltage polarity of subpixels during drive at 3-dot pitch in a field is shown. In a subsequent field, the voltage polarity at each subpixel is inverted.

The above described relationship between the number of subpixels and the voltage polarity inversion pitch (in 1.) is Q=2 and P=3 in the case shown in FIGS. 10(*a*) and 10(*b*); Q=4 and P=3 in the case shown in FIGS. 11(*a*) and 11(*b*); and Q=6 and P=1 in the case shown in FIGS. 12(*a*) and 12(*b*).

In either case, P is an odd number, so that in one field, the voltage polarity is imbalance in the row direction but adjacent two rows have opposite polarity patterns to each other. As a result, the number of positive-polarity driven dots is equal to that of negative-polarity driven dots in the two rows as a whole. In this manner, in the case where the subpixel arrangement is identical with respect to all the rows, an imbalance of voltage polarity is removed by effecting inversion of voltage polarity every row to prevent an occurrence of flicker.

However, as shown in FIGS. 9 to 12, when the same row arrangement pattern is also repeated in the column direction, an image edge is colored depending on display as described above, thus resulting in an inferior result in some cases. For this reason, such an arrangement that a subpixel arrangement pattern in a certain row is shifted as it is in a row direction in a subsequent row has been frequently performed.

Flicker occurring in the case where different subpixel arrangements are given in adjacent two rows will be considered below.

Even when the subpixel arrangement pattern is shifted every row, the above described relationship between the voltage polarity and the number of subpixels (in 1.) in one row is not changed. When the subpixels are arranged in the order of $A_1, A_2, \ldots A_Q$ in a row and the subpixel arrangement pattern is shifted by one dot in the row direction in an adjacent row, the above described effects in 1. are achieved as they are when the unit pixel having the shifted subpixel arrangement pattern is regarded as a pixel having subpixels arranged in the order of $A_Q, A_1, A_2, \ldots, A_{Q-1}$.

More specifically, when L and P are defined similarly as in the case of 1. described above, if P is an even number, the number of positive-polarity driven subpixels is equal to that of negative-polarity driven subpixels with respect to any subpixels in one row. Accordingly, in the case where P is an even number, even when the subpixel arrangement in a row is shifted in any manner in a different row, there is no difference in optical characteristic between different fields. As a result, flicker is not caused to occur.

In the case where P is an odd number, in one row, the numbers of positive- and negative-polarity driven subpixels are always different from each other, so that flicker is caused to occur when only the row is noted. However, when different subpixel arrangements are given in two rows and an imbalance in one row cancels that in the other row, the positive polarity subpixels and the negative polarity subpixels have the same number in these two rows. As a result, flicker can be removed. Based on this concept, according to the present invention, there is provided a flicker-less display apparatus.

Hereinbelow, explanation will be made in further detail.

(2-1) Case where P=Odd Number and J=Even Number

Figure 13:
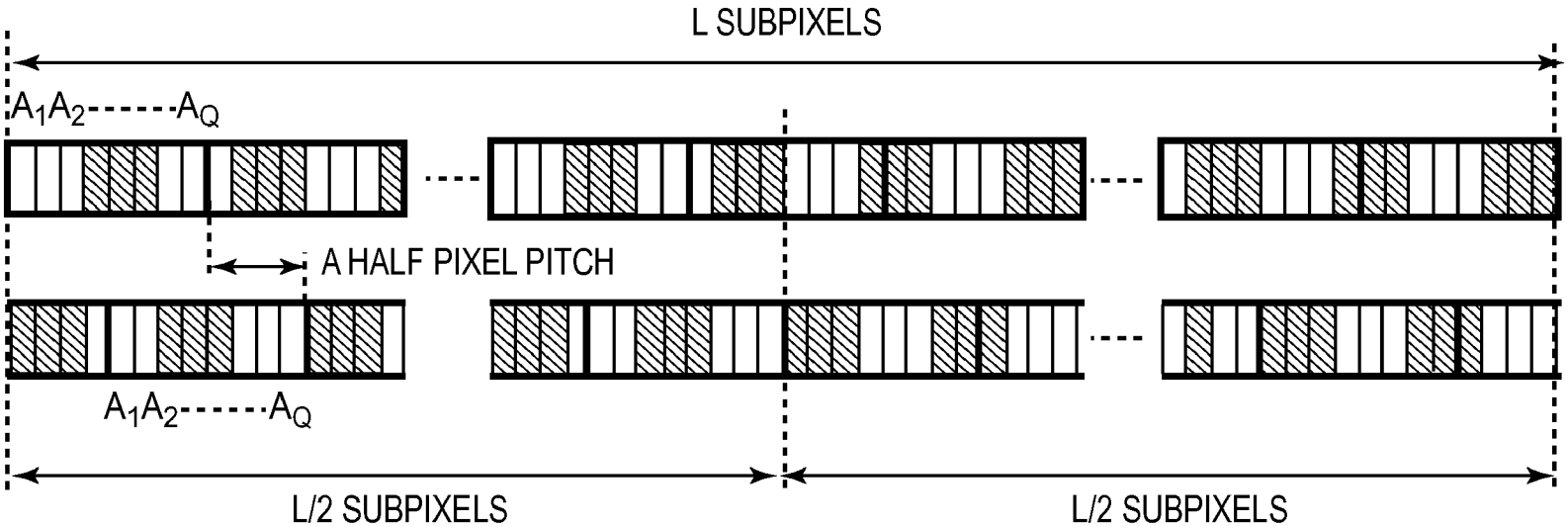
FIG. 13 is a schematic view for illustrating application of the present invention to the case where a subpixel arrangement is different between adjacent two rows.

FIG. 13 shows a subpixel arrangement pattern and a voltage polarity pattern in the rows in the case where P is an odd number and J is an even number similarly as in the case shown in FIG. 7. In two adjacent rows, the polarity of voltage applied to the subpixels is inverted and the subpixel arrangement pattern is shifted by Q/2 dots from each other.

When J is an even number, in the row in which the subpixel arrangement pattern is shifted by Q/2 dots, compared with the other row, the first group and the second group of the subpixel arrangement pattern are replaced with each other. In other words, in the entire L dots, the left L/2 dots and the right L/2 dots of the division (bisection) point may be replaced with each other.

Further, the voltage polarity patterns in the two rows have an inversion relationship therebetween, and J is an even number, so that the left L/2 dots and the right L/2 dots have the same voltage polarity pattern.

Accordingly, also as shown in FIG. 13, the left L/2 dots in the first row and the right L/2 dots in the second row have the same subpixel arrangement pattern and have opposite voltage polarity patterns. This means that the subpixels of the left L/2 dots in the first row and those of the right L/2 dots in the second row cancel the imbalance each other.

Accordingly, with respect to two rows, by shifting the subpixel arrangement pattern by Q/2 dots each other, the number of positive polarity subpixels is equal to that of negative polarity subpixels even in either of the odd field and the even field. As a result, flicker is removed.

(2-2) Case where P=Odd Number and J=Odd Number

In the case where J is an odd number, similarly as in the case where J is an even number, when the voltage polarity is inverted in adjacent rows and the subpixel arrangement is shifted by Q/2 in the row direction, the subpixel arrangement pattern in the first group is replaced with that in the second group. However, in addition thereto, the left and right voltage polarity patterns are also replaced with each other, so that the imbalance is not changed from that in the previous row. As a result, the imbalance cannot be cancelled.

Figure 14:
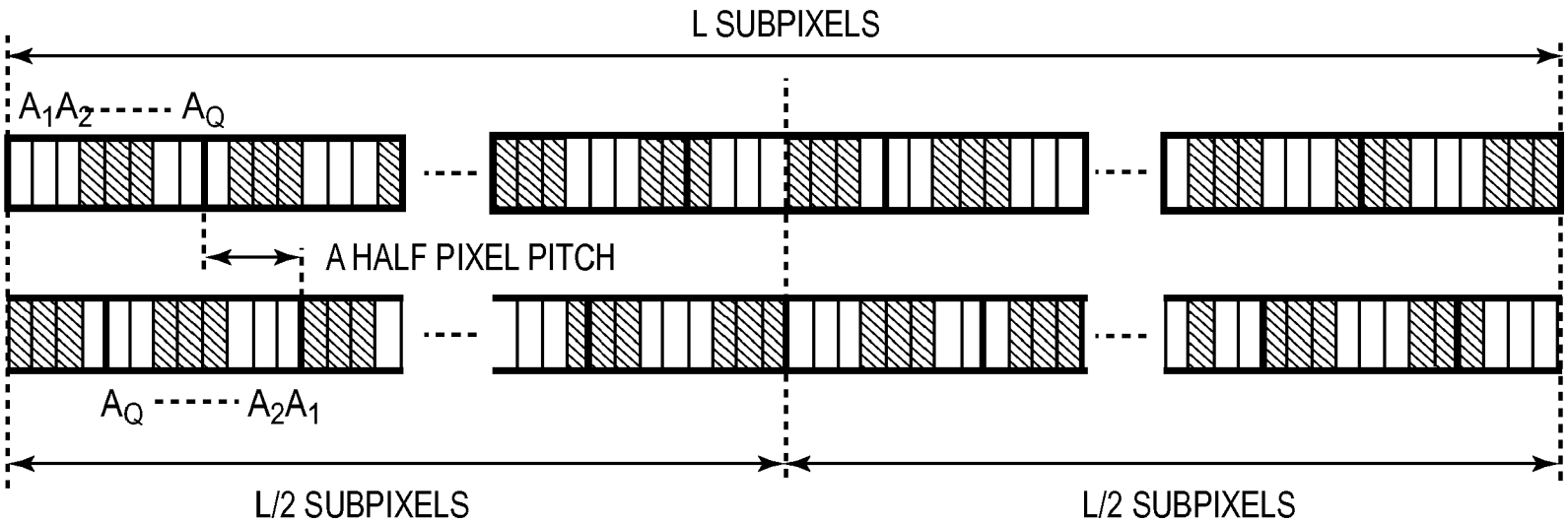
FIG. 14 is a schematic view showing a characteristic of applied voltage during 3 dot inversion drive in an arrangement of color filter shown in FIG. 13.

FIG. 14 shows a subpixel apparatus pattern and a voltage polarity pattern in two rows in the case where P is an odd number and J is also odd number similarly as in the case shown in FIG. 8 except that the subpixel apparatus pattern in the second row is shifted from that in the first row by Q/2 dots and the order of arrangement is reversed.

As described above, when the subpixel apparatus pattern is shifted by Q/2 dots while being reversed in the arrangement order, the entire subpixel arrangement in the second row is equivalent to that in the L/2 dots, in the first row, in which the order of arrangement is reversed.

In FIG. 14, when the left L/2 dots in the first row are compared with those in the second row or when the right L/2 dots in the first row are compared with those in the second row, the entire subpixel arrangements are identical to each other although the orders of arrangement are opposite to each other and the voltage polarity patterns are opposite to each other. Accordingly, the left half subpixels in the first row and the left half subpixels in the second row can cancel the imbalance each other. This is true for the right half subpixels in the first and second rows.

In this manner, also in the case where both P and J are an odd number, by reversing in arrangement order and shifting the subpixel arrangement by Q/2 dots in adjacent two rows, the positive and negative voltage polarities are balanced with respect to any subpixel. Thus, it has been found that flicker can be obviated.

The above described results will be applied to the subpixel arrangements shown in FIGS. 10-12.

In the subpixel arrangement shown in FIGS. 10(*a*) and 10(*b*), Q=2, so that L=6, P=3, and J=1. As a result, P and J are odd numbers. Accordingly, when the subpixel arrangement is that in the first row shown in FIG. 10(*a*) or 10(*b*), the subpixel arrangement in the second row is a subpixel arrangement in which subpixels M and G are replaced with each other and it is shifted by half pitch, i.e., one dot in the row direction.

However, by this operation, the subpixel arrangement in the second row is returned to that in the first row, so that the subpixel arrangement in the second row is equal to that in the second row. Consequently, in the case of Q=2, the subpixel arrangement in the first and second rows result in the same subpixel arrangement.

Figure 15:
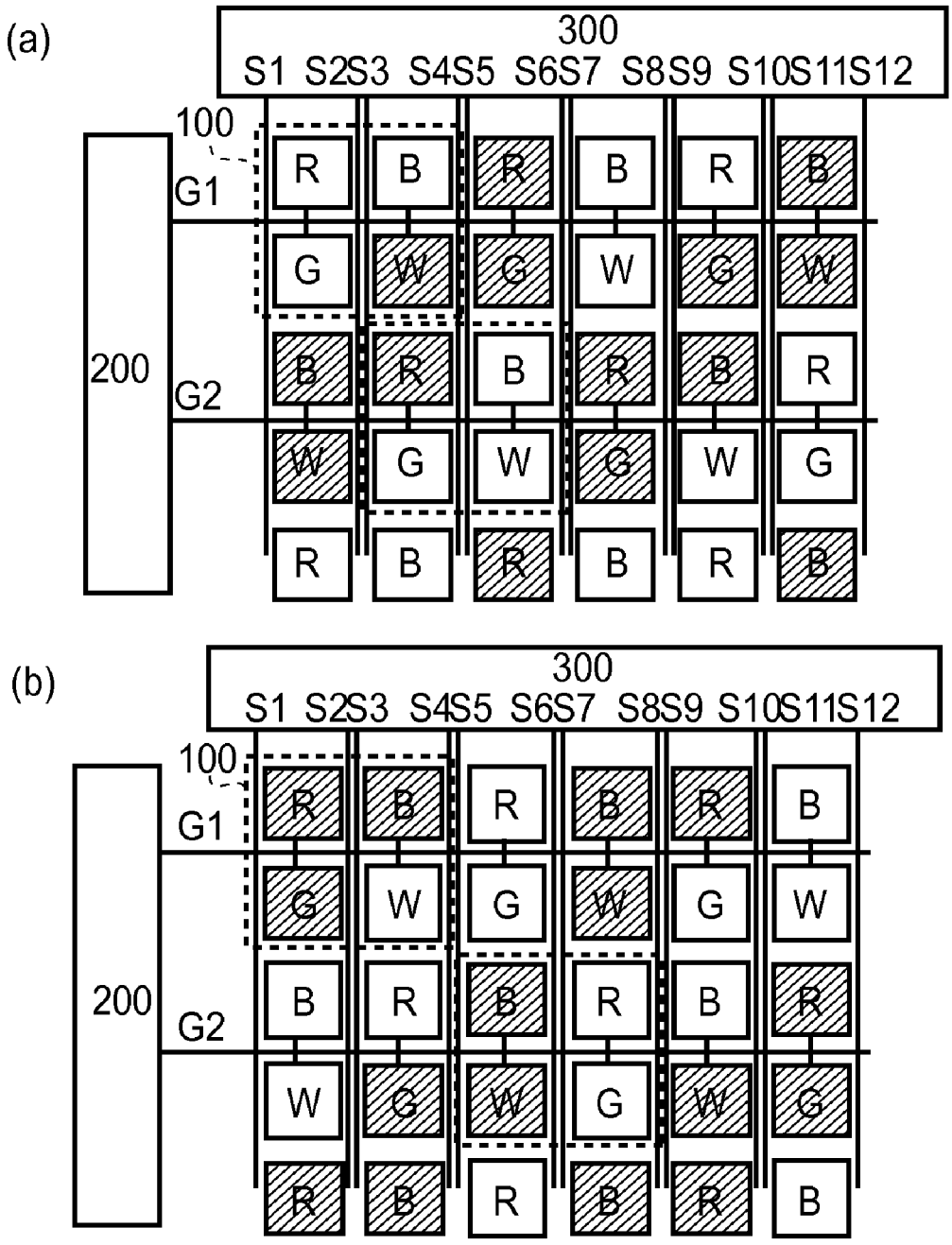
FIGS. 15(*a*) and 15(*b*) and FIGS. 16(*a*) and 16(*b*) are schematic views each showing a pixel constitution of a color liquid crystal display device in a field in an embodiment.

In the case shown in FIGS. 11(*a*) and 11(*b*), Q=4, so that L=12, P=3, and J=2. Accordingly, P is an odd number and J is an even number. According to the above obtained results, based on the subpixel arrangement shown in FIG. 10(*b*), the order of the subpixel arrangement is kept as it is and the subpixel arrangement in an even row is shifted by half pitch (i.e., 2 dots) in the row direction. The resultant subpixel arrangement is shown in FIGS. 15(*a*) and 15(*b*), wherein FIG. 15(*a*) shows the subpixel arrangement in a field and FIG. 15(*b*) shows that in a subsequent field similarly as in FIGS. 11(*a*) and 11(*b*). In each field, it is found that the voltage polarities are well balanced.

Figure 16:
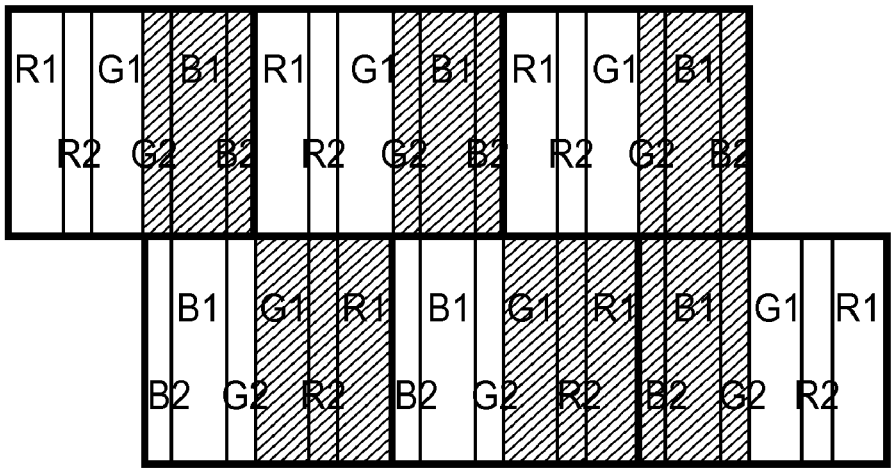
Figure 16:
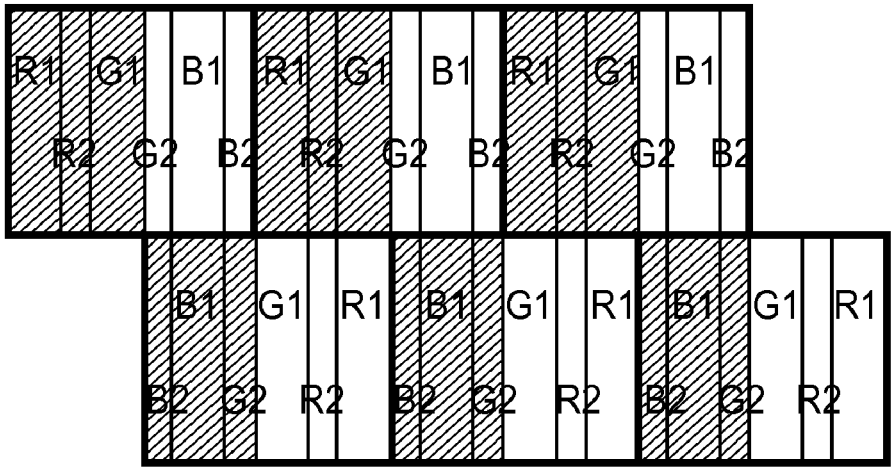

In the case shown in FIGS. 12(*a*) and 12(*b*), Q=6, so that L=6, P=1, and J=1. Accordingly, both P and J are an odd number. According to the above obtained results, based on the subpixel arrangement shown in FIGS. 12(*a*) and 12(*b*), the order of the subpixel arrangement in the even row is reversed and the subpixel arrangement in an even row is shifted by half pitch (i.e., 2 dots) in the row direction. The resultant subpixel arrangement is shown in FIGS. 16(*a*) and 16(*b*), wherein FIG. 16(*a*) shows the subpixel arrangement in a field and FIG. 16(*b*) shows that in a subsequent field similarly as in FIGS. 121 (*a*) and 12 (*b*). Also in this case, in each field, it is found that the voltage polarities are well balanced.

In the above description, a unit of polarity inversion is 3 dots but may be changed to any number of dots. When the number of the unit of polarity inversion is taken as S, the polarity inversion period (pitch) described above as 6 can be generalized by replacing it with 2S.

Next, embodiments in which the above described results are applied to a hybrid color liquid crystal display device will be described.

Various-type color liquid crystal display devices can be used as the color liquid crystal display device usable in the present invention. Explanation for display principle thereof will be made by taking a color liquid crystal display device utilizing ECB effect as an example.

Figure 17:
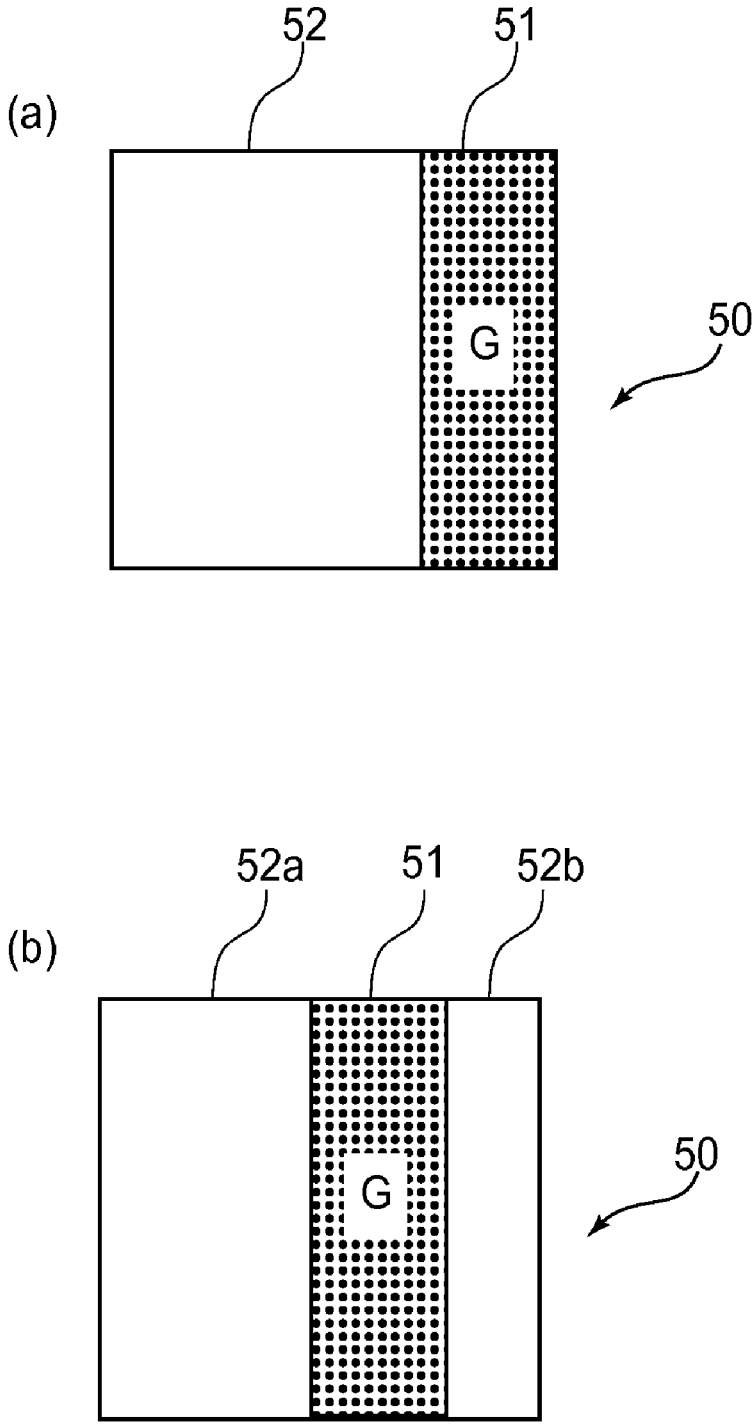
FIGS. 17(*a*) and 17(*b*) are schematic views showing an arrangement of color filter in Example 1 and an improved arrangement of color filter thereof, respectively.

FIGS. 17(*a*) and 17(*b*) each shows a constitution of one pixel of a hybrid color display apparatus.

In the color liquid crystal display device (color display device) usable in the present invention, as shown in FIG. 17(*a*), one pixel 50 is divided into a plurality (two) of subpixels 51 and 52, wherein the subpixel 51 is provided with a color filter of green indicated by a symbol G and the other subpixel 52 is used for causing a change in brightness of achromatic color from black to white by adjusting a retardation and for displaying any one of colors from red to blue through magenta.

More specifically, a unit pixel is constituted by the first subpixel 52 for displaying chromatic color by changing a retardation of liquid crystal layer under voltage application and the second subpixel 51 which is provided with the green color filter and displays the color (green) of the color filter by changing the retardation in a brightness change range under voltage application. In other words, the pixel constitution is characterized in that at the subpixel 51 for displaying green having high luminosity factor (hereinafter referred to as a "green subpixel"), the green color filter G is used without utilizing an ECB effect-based coloring phenomenon and the ECB effect-based coloring phenomenon is utilized only for red and blue.

In the color liquid crystal display device shown in FIG. 17(*a*), at the green subpixel 51, it is possible to effect continuous gradation display but at the transparent subpixel 52, it is impossible to effect gradation display since a chromatic color display state of red and blue utilizes the ECB effect-based coloring phenomenon.

An improved pixel constitution in this regard is shown in FIG. 17(*b*), wherein the transparent subpixel 52 is divided into two subpixels 52*a* and 52*b* and an areal ratio therebetween is changed to effect digital gradation display. Here, the subpixels 52*a* and 52*b* have different areas, so that by a combination of the areas of the subpixels 52*a* and 52*b* for displaying colors by being turned on, some levels of intermediary color are displayed.

By increasing the number of division so as to provide an areal ratio of 1:2: . . . :$2^{N+1}$ (N: the number of division of transparent pixel), it is possible to provide a gradation display characteristic having high linearity.

Figure 18:
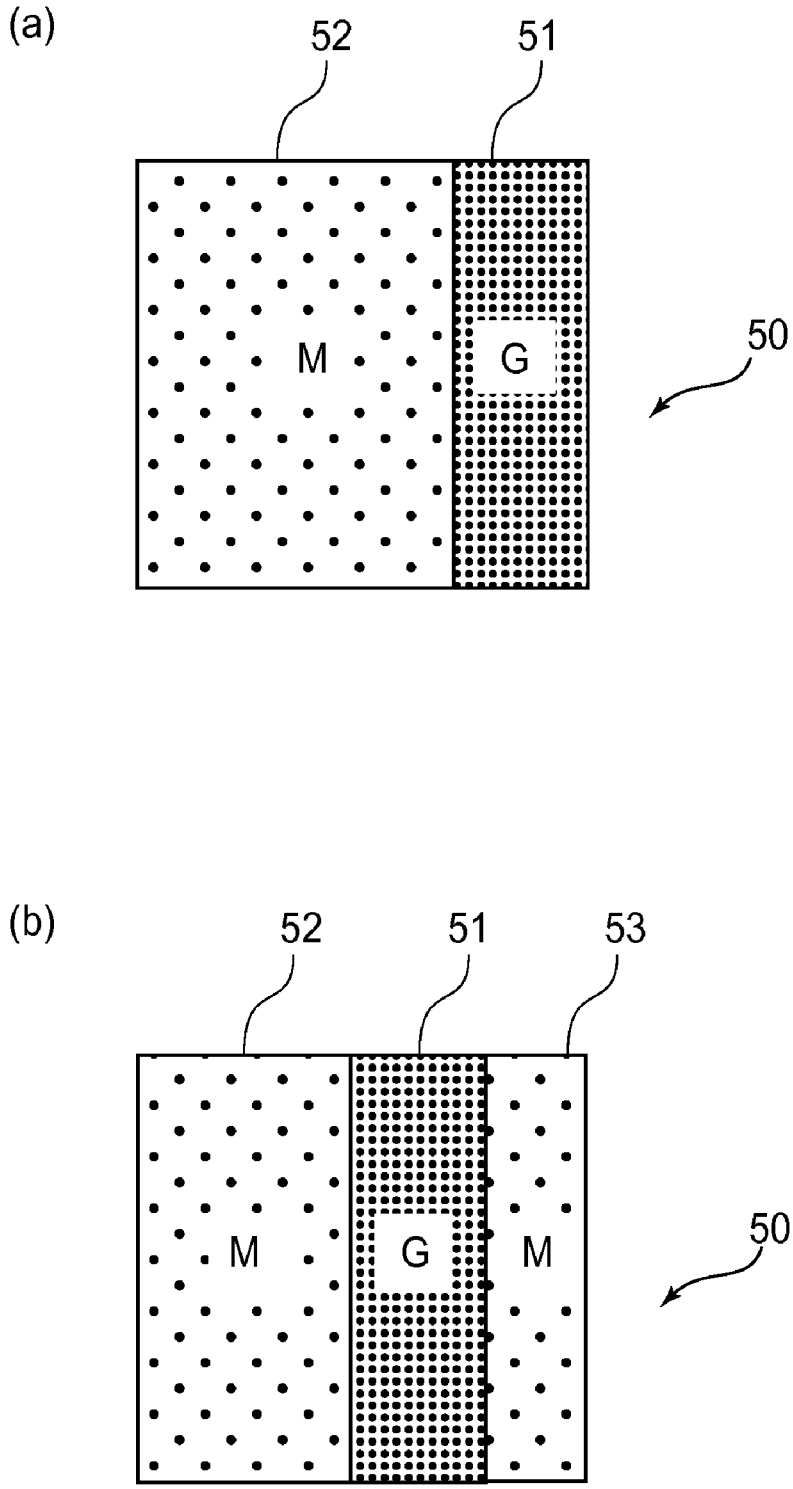
FIGS. 18(*a*) and 18(*b*) are schematic views each showing an arrangement of color filter in a modified embodiment of the embodiment shown in FIGS. 17(*a*) and 17(*b*).

FIGS. 18(*a*) and 18(*b*) each shows an embodiment improved in color purity of the basic pixel constitution shown in FIG. 17(*a*).

Referring to FIG. 18(*a*), the green subpixel 51 has the same structure as that provided with the green color filter in the basic pixel constitution shown in FIG. 17(*a*) but the transparent subpixel 52 is provided with a color filter of magenta indicated by a symbol M. At the green subpixel 51, modulation in a brightness change range is performed similarly as in the pixel constitution shown in FIG. 17(*a*) to change a brightness of green. At the magenta subpixel 52, chromatic color is displayed by performing modulation in a hue change range and display for changing a brightness of magenta by performing modulation in a brightness change range.

In this manner, by providing the subpixel 52 colored by the change in retardation with a color filter of color complementary to green, it becomes possible to extend color reproduction ranges of red and blue.

FIG. 18(*b*) shows an example of a pixel constitution in which a subpixel provided with a magenta color filter is divided into two portions 52 and 53 at an areal ratio of 2:1 in order to effect gradation display.

In the case where the gradation display is effected by pixel division, the number of available colors is increased with the number of pixel division. However, this method is only based on digital gradation, thus failing to effect analog full-color display.

Figure 19:
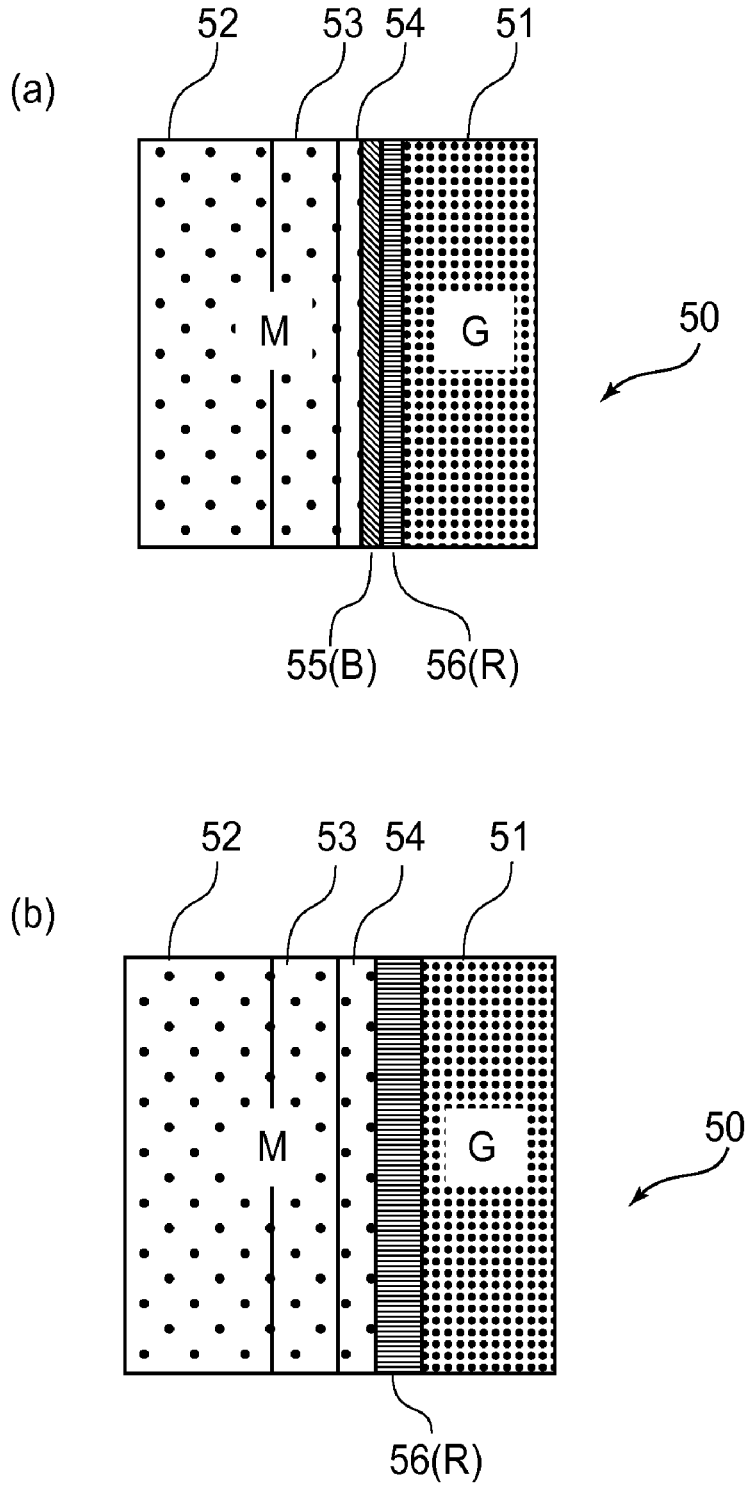
FIGS. 19(*a*) and 19(*b*) are schematic views showing a pixel constitution used in Example 4 and another pixel constitution.

FIGS. 19(*a*) and 19(*b*) each shows a pixel constitution for providing analog gradation in a hybrid color display mode.

As shown in FIG. 19(*a*), to the basic pixel constitution shown in FIG. 17(*a*), third and fourth subpixels 55 and 56 provided with a red color filter and a blue color filter, respectively are added. These subpixel 55 and 56 are driven at the same voltage as that of the subpixel 51 provided with the green color filter to cause changes in continuous brightness of red and blue, respectively. As a result, it is possible to compensate gradation levels between the discontinuous gradation levels of the magenta subpixel, so that it is possible to effect gradation display also with respect to red and blue.

The number of magenta subpixel may be one but may also be divided into plural portions. The third and fourth subpixels 55 and 56 provided with the red and blue color filters, respectively, are used for compensating a gap of the digital gradation level of magenta, so that at these subpixels, modulation is performed so as to provide a brightness substantially equal to that given at a minimum subpixel of the subpixels constituting the magenta subpixel. Accordingly, the sizes of the third and fourth subpixels 55 and 56 may be sufficient so long as they have an area equal to a minimum area of the subpixel of the pixel-divided magenta subpixels.

The red and blue color filters absorb not less than ⅓ of external light, so that occupation of larger area of them are not preferred from the viewpoint of light utilization efficiency. As the number of pixel division is increased, it becomes possible to reduce the influence of lowering in light utilization efficiency due to the use of the red and blue color filters.

Incidentally, it is possible to achieve a good effect even when both the red and blue color filters are not necessarily added.

FIG. 19(*b*) shows an example thereof. In this case, only a subpixel 56 provided with a red color filter is added.

With respect to red in this case, continuous gradation is realized, so that all the colors are displayable. However, with respect to colors containing blue as a mixed color component, the resultant color levels are discontinuous, so that there are colors which cannot be displayed. In this case, however, it is considered that a human luminosity characteristic is least sensitive with respect to blue and thus the number of gradation levels required for blue may be smallest. For this reason, it is possible to effect display close to full-color display by adding only the red color filter.

In the hybrid color liquid crystal mode, various liquid crystal display modes described below for use in the conventional RGB color display method can be employed by extending the retardation range upward.

Examples of the liquid crystal display modes may include the following modes.

In a vertical alignment (VA) mode, liquid crystal molecules of a liquid crystal layer are aligned perpendicularly to a substrate surface when a voltage is not applied and are inclined from the direction perpendicular to the substrate surface to change a retardation.

In an optically compensated bend (OCB) mode, liquid crystal molecules of a liquid crystal layer are changed in alignment state under voltage application between bend alignment and substantially vertical alignment, so that the present invention is applicable to this mode similarly as in the case of the VA mode.

A multidomain vertical alignment (MVA) mode has already been put into practical use as a mode providing a very good viewing angle characteristic and has been widely used. Similarly, a patterned vertical alignment (PVA) mode has been widely used.

In these modes, a surface unevenness is provided (MVA mode) or an electrode shape is appropriately modified (PVA mode) to control an inclination direction of the liquid crystal molecules during voltage application. Further, these modes are such a mode that a retardation amount is changed by voltage, so that the constitutions of the present invention are applicable thereto.

EXAMPLES

Hereinbelow, the active matrix display apparatus (color liquid crystal display apparatus) according to the present invention will be described more specifically based on Examples 1-3. In these examples, a 3-dot inversion drive method is employed, but inversion drive methods other than the 3-dot inversion drive may also be applicable to these examples.

Figure 20:
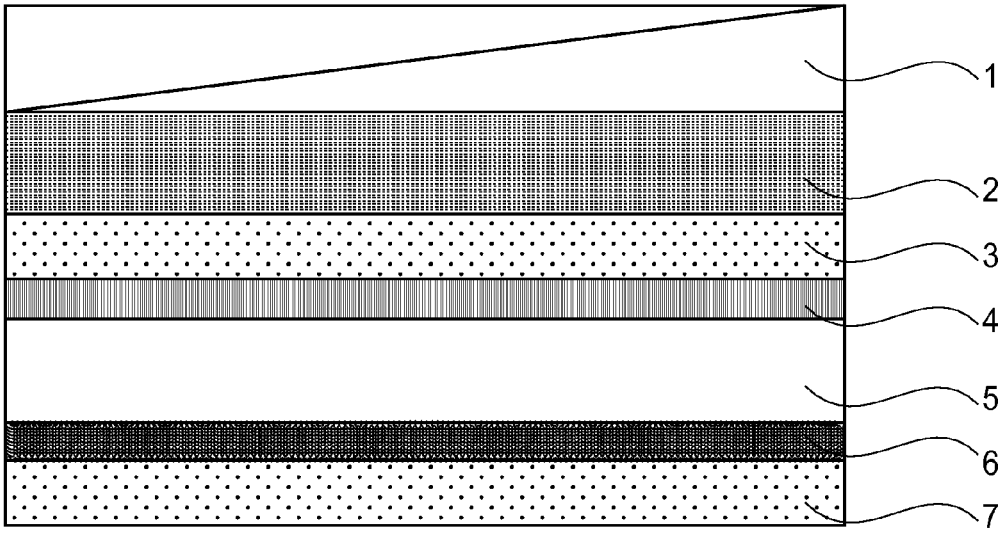
FIG. 20 is a schematic view showing a cross-sectional structure of the active matrix display apparatus of the present invention.

A common constitution of a color liquid crystal display device used in the respective examples is shown in FIG. 20.

A cell is prepared by applying two glass substrates 3 and 7, which have been subjected to vertical alignment treatment, to each other. Into the cell, as a liquid crystal 5, a liquid crystal material (Model "MLC-6608", mfd. by Merck Co.) having a negative dielectric anisotropy ($-\Delta\in$) is injected. A cell thickness is adjusted so as to provide an optimum retardation.

On the substrate 7, unshown thin film transistors (TFTs) are disposed to constitute an active matrix drive circuit. On the other substrate 3, an unshown color filter is disposed. A shape of pixel and a constitution of the color filter are specifically described in the respective examples.

On the substrate 3 provided with the color filter, a transparent electrode 4 is formed, and on the substrate 7 provided with the TFTs, an aluminum electrode 6 is formed to prepare a reflection-type display. In order to realize a normally black display mode, a phase compensation plate 3 is disposed between the upper substrate (color filter substrate) 3 and a polarizer 1.

Example 1

A hybrid color liquid crystal display device used in this example has a pixel constitution as shown in FIG. 17 (*a*). One unit pixel 50 is divided into two subpixels 51 and 52. The subpixel 51 is provided with a green color filter and the other subpixel 52 is provided with a magenta color filter. The color liquid crystal display device has a cell thickness of 5 μm. A retardation when a voltage of ±5 V is applied to the cell is about 350 nm.

When a voltage is applied to the above prepared hybrid color liquid crystal display device, at the subpixel 51 provided with the green color filter, a change in transmittance depending on an applied voltage value of not more than 3 V is caused and thus a continuous gradation characteristic is provided. On the other hand, at the magenta color filter subpixel 52, blue display is effected when a voltage of 5 V is applied and red display is effected when a voltage of 3.8 V is applied. As a result, display of the three primary colors can be effected at the two subpixels 51 and 52 as a whole. Further, when a voltage of not more than 3 V is applied, monochromatic gradation display depending on a magnitude of applied voltage is effected.

FIGS. 10(*a*) and 10(*b*) show a matrix display panel in which the above described unit pixel 50 is arranged in such a manner that each of the green color filter and the magenta color filter is arranged in a tripe shape in a column direction. The thus prepared matrix display panel having a plurality of pixels arranged as described above is driven by providing it with driver ICs used for driving an ordinary RGB color display method, whereby it is possible to perform flicker-less 3-dot inversion drive.

Example 2

A color liquid crystal display device used in this example has such a pixel constitution that one unit pixel 50 is divided into subpixels 51 to 54. The subpixel 51 is provided with a green color filter. The subpixels 52, 53 and 54 (M1, M2 and M3) are provided with a magenta color filter and have an areal ratio of 4:2:1. As a result, the numbers of gradation levels of red and blue are increased.

The unit pixel is arranged as shown in FIGS. 21(*a*) and 21(*b*) so that the subpixels 50 to 54, i.e., G, M1, M2 and M3 are repeatedly arranged in this order in a row direction.

In this example, the respective color filters having the same color and the same shape (size) are arranged in a stripe shape in the row direction. The thus prepared matrix display panel having a plurality of pixels arranged as described above is driven by providing it with driver ICs used for driving an ordinary RGB color display method, whereby it is possible to perform flicker-less 3-dot inversion drive.

Example 3

A color liquid crystal display device in this example having a pixel constitution as shown in FIGS. 22(*a*) and 22(B) is prepared in the same manner as in Example 2 except that the order of subpixel arrangement in even-numbered rows is shifted from that in odd-numbered rows by two dots, i.e., half of a pixel pitch, in the row direction. The thus prepared matrix display panel having a plurality of pixels arranged as described above is driven by providing it with driver ICs used for driving an ordinary RGB color display method, whereby it is possible to perform flicker-less 3-dot inversion drive.

Example 4

A color liquid crystal display device in this example has a pixel constitution as shown in FIG. 19(*a*). One unit pixel 50 is divided into six subpixels 51 to 56. The subpixel 51 is provided with a green color filter G. The three color filters 52, 53 and 54 are provided with a magenta color filter M. The remaining two subpixels 55 and 56 are provided with a blue (B) color filter and a red (R) color filter, respectively.

The magenta subpixels 52 to 54 have an areal ratio of 4:2:1. The red subpixel 55 and the blue subpixel 56 have an area equal to that of the minimum magenta subpixel 54. By this constitution, it is possible to realize analog full-color display.

The above described unit pixel 50 is arranged so that the color filters of magenta (M), magenta (M), magenta (M), blue (B), red (R), and green (G) are arranged in a stripe shape in the row direction. The thus prepared matrix display panel having a plurality of pixels arranged as described above is driven by providing it with driver ICs used for driving an ordinary RGB color display method, whereby it is possible to perform flicker-less 3-dot inversion drive.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 363719/2004 filed Dec. 15, 2004, and 349845/2005 filed Dec. 2, 2005 which are hereby incorporated by reference.

What is claimed is:

1. An active matrix display apparatus, comprising:

an active matrix display panel comprising a plurality of pixels arranged in a matrix in a row direction and a column direction, each pixel being constituted by a plurality of subpixels; and a drive circuit for applying a voltage to each of the subpixels so that a polarity of the voltage is inverted at a predetermined period in a row direction and inverted alternately in a column direction, wherein the plurality of subpixels are arranged in the row direction at a period different from half of the predetermined period of polarity inversion of the voltage in the row direction, wherein subpixel arrangement in a row is shifted from subpixel arrangement in an adjacent row by half of the period of subpixel arrangement, and wherein said drive circuit applies the voltage to the subpixels at a period of polarity inversion of voltage such that a common period of subpixel arrangement and polarity inversion of voltage in the row direction includes a period of an odd number of recurring units of subpixel arrangement and a period of an even number of recurring units of polarity inversion of voltage.

2. An apparatus according to claim 1, wherein the half of the predetermined period of polarity inversion of the voltage in the row direction is 3 in terms of the number of subpixels.

3. An apparatus according to claim 2, wherein the period of the subpixel arrangement in the row direction is 2 in terms of the number of subpixels, and one of 2 subpixels in the period is provided with a green color filter and the other subpixel is provided with a magenta color filter.

4. An apparatus according to claim 2, wherein the period of the subpixel arrangement in the row direction is not less than 4 in terms of the number of subpixels, and one of not less than 4 subpixels in the period is provided with a green color filter and not less than 2 other subpixels are provided with a magenta color filter.

5. An apparatus according to claim 2, wherein the period of the subpixel arrangement in the row direction is not less than 5 in terms of the number of subpixels, and wherein one of not less than 5 subpixels in the period is provided with a green color filter and not less than 2 other subpixels are provided with a magenta color filter, another one subpixel is provided with a red color filter, and more another one subpixel is provided with a blue color filter.

6. An active matrix display apparatus, comprising:

an active matrix display panel comprising a plurality of pixels arranged in a matrix in a row direction and a column direction, each pixel being constituted by a plurality of subpixels; and a drive circuit for applying a voltage to each of the subpixels so that a polarity of the voltage is inverted at a predetermined period in a row direction and inverted alternately in a column direction, wherein the plurality of subpixels are arranged in the row direction at a period different from half of the predetermined period of polarity inversion of the voltage in the row direction, wherein subpixel arrangement in a row is inverted and shifted from subpixel arrangement in an adjacent row by half of the period of subpixel arrangement, and wherein said drive circuit applies the voltage to the subpixels at a period of polarity inversion of voltage such that a common period of subpixel arrangement and polarity inversion of voltage in the row direction includes a period of an odd number of recurring units of subpixel arrangement and a period of an odd number of recurring units of polarity inversion of voltage.

7. An apparatus according to claim 6, wherein the half of the predetermined period of polarity inversion of the voltage in the row direction is 3 in terms of the number of subpixels.

8. An apparatus according to claim 7, wherein the period of the subpixel arrangement in the row direction is 2 in terms of the number of subpixels, and one of 2 subpixels in the period is provided with a green color filter and the other subpixel is provided with a magenta color filter.

9. An apparatus according to claim 7, wherein the period of the subpixel arrangement in the row direction is not less than 4 in terms of the number of subpixels, and one of not less than 4 subpixels in the period is provided with a green color filter and not less than 2 other subpixels are provided with a magenta color filter.

10. An apparatus according to claim 7, wherein the period of the subpixel arrangement in the row direction is not less than 5 in terms of the number of subpixels, and wherein one of not less than 5 subpixels in the period is provided with a green color filter and not less than 2 other subpixels are provided with a magenta color filter, another one subpixel is provided with a red color filter, and more another one subpixel is provided with a blue color filter.

11. A method of driving an active matrix display apparatus, comprising:

a step of driving an active matrix display panel comprising a plurality of pixels arranged in a matrix in a row direction and a column direction, each pixel being constituted by a plurality of subpixels, by a drive circuit for applying a voltage to each of the subpixels so that a polarity of the voltage is inverted at a predetermined period in each of a row direction and a column direction, wherein the plurality of subpixels are arranged in the row direction at a period different from half of the predetermined period of polarity inversion of the voltage in the row direction, wherein subpixel arrangement in a row is shifted from subpixel arrangement in an adjacent row by half of the period of subpixel arrangement, and wherein said drive circuit applies the voltage to the subpixels at a period of polarity inversion of voltage such that a common period of subpixel arrangement and polarity inversion of voltage in the row direction includes a period of an odd number of recurring units of subpixel arrangement and a period of an even number of recurring units of polarity inversion of voltage.

12. A method of driving an active matrix display apparatus, comprising:

a step of driving an active matrix display panel comprising a plurality of pixels arranged in a matrix in a row direction and a column direction, each pixel being constituted by a plurality of subpixels, by a drive circuit for applying a voltage to each of the subpixels so that a polarity of the voltage is inverted at a predetermined period in each of a row direction and a column direction, wherein the plurality of subpixels are arranged in the row direction at a period different from half of the predetermined period of polarity inversion of the voltage in the row direction, wherein subpixel arrangement in a row is inverted and shifted from subpixel arrangement in an adjacent row by half of the period of subpixel arrangement, and wherein said drive circuit applies the voltage to the subpixels at a period of polarity inversion of voltage such that a common period of subpixel arrangement and polarity inversion of voltage in the row direction includes a period of an odd number of recurring units of subpixel arrangement and a period of an odd number of recurring units of polarity inversion of voltage.

* * * * *